United States Patent [19]

Koizumi et al.

[11] 4,327,801

[45] May 4, 1982

[54] CYLINDRICAL HEAT EXCHANGER USING HEAT PIPES

[75] Inventors: Tatsuya Koizumi, Tokyo; Shuichi Furuya; Koji Matsumoto, both of Yokohama; Kensuke Karasawa, Machida, all of Japan

[73] Assignee: The Furukawa Electric Company, Ltd., Tokyo, Japan

[21] Appl. No.: 91,949

[22] Filed: Nov. 7, 1979

Related U.S. Application Data

[62] Division of Ser. No. 875,092, Feb. 3, 1978, Pat. No. 4,206,807.

[30] Foreign Application Priority Data

| | | | |
|---|---|---|---|
| Jan. 31, 1977 | [JP] | Japan | 52-10200[U] |
| Jun. 2, 1977 | [JP] | Japan | 52-71954[U] |
| Aug. 17, 1977 | [JP] | Japan | 52-98335 |
| Aug. 17, 1977 | [JP] | Japan | 52-98336 |
| Aug. 17, 1977 | [JP] | Japan | 52-98337 |

[51] Int. Cl.[3] ..... F28D 15/00

[52] U.S. Cl. ..... 165/104.21; 165/54; 165/125; 165/DIG. 5

[58] Field of Search ..... 165/105, 125, 86, 54, 165/104.21, DIG. 5

[56] References Cited

U.S. PATENT DOCUMENTS

| | | | |
|---|---|---|---|
| 3,616,849 | 11/1971 | Dijt | 165/125 X |
| 3,887,515 | 4/1975 | Laing | 165/125 |

FOREIGN PATENT DOCUMENTS

| | | | |
|---|---|---|---|
| 495929 | 9/1953 | Canada | 165/105 |
| 595956 | 5/1934 | Fed. Rep. of Germany | 165/105 |
| 2508021 | 8/1975 | Fed. Rep. of Germany | 165/125 |
| 49-40053 | 9/1974 | Japan . | |
| 52-53463 | 4/1977 | Japan . | |

OTHER PUBLICATIONS

Silverstein, CC, *Heat Pipe Gas Turbine Regenerators*, ASME Paper 68-WA/GT-7, 10/1/1969, 9 pages.

*Primary Examiner*—Albert W. Davis

*Attorney, Agent, or Firm*—Armstrong, Nikaido, Marmelstein & Kubovcik

[57] ABSTRACT

This invention relates to an improvement in a heat exchanger of the type using heat pipes which permits reduction in size of the heat exchanger and enhancement in heat exchange efficiency and more particularly to a cylindrical heat exchanger principally comprising a cylindrical or polygonal tubular casing provided with openings in the middle parts of its upper and lower sides and in its circumferential side, a transverse partition plate which divides the inside of the casing into upper and lower parts and a group of vertical heat pipes arranged to pierce through the peripheral portion of the partition plate in an annular plan configuration as a whole.

2 Claims, 34 Drawing Figures

FIG. 15(A)
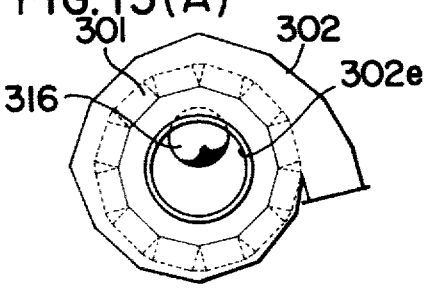
FIG. 16(A)
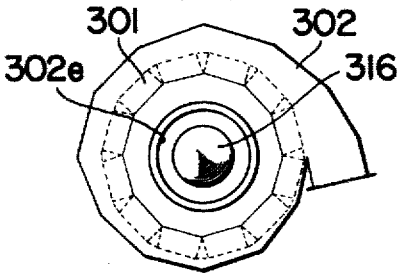
FIG. 15(B)
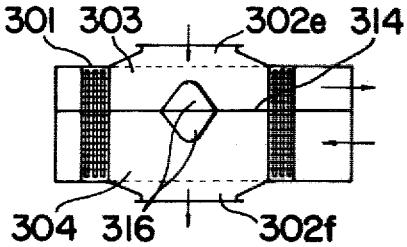
FIG. 16(B)
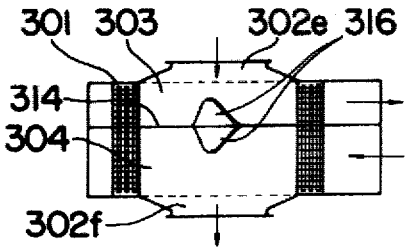
FIG. 17(A)
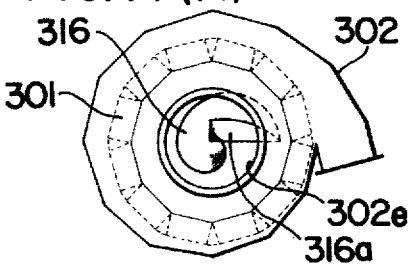
FIG. 18(A)
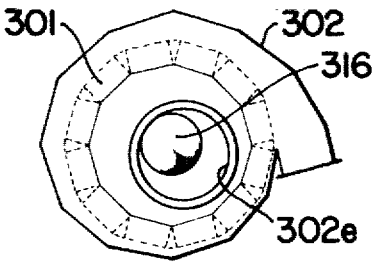
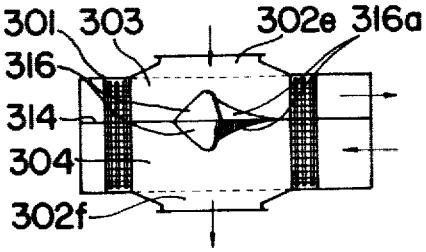
FIG. 17(B)
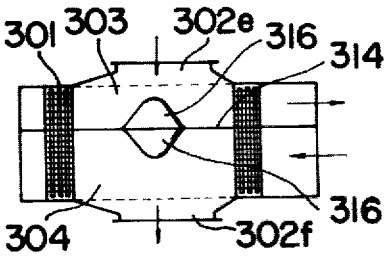
FIG. 18(B)

CYLINDRICAL HEAT EXCHANGER USING HEAT PIPES

This is a division of application Ser. No. 875,092, filed Feb. 3, 1978 now U.S. Pat. No. 4,206,807 granted Oct. 10, 1980.

BRIEF DESCRIPTION OF THE DRAWINGS

In FIGS. 1 through 3, a reference numeral 3 indicates heat pipes; 5 a radiating portion; 6 an heat receiving portion; 7 a heat exchange portion; 8 a casing; 9 a partition plate; 10 fins; 11 a partition plate; 12 an exhaust port; 13 an intake port; 14 another intake port; and 15 another exhaust port.

In FIGS. 4 through 7, a reference numeral 101 indicates a heat exchange portion; 102*a* a casing body; 102*b* a partition plate; 102*c* an exhaust port; 102*d* an intake port; 102*e* another intake port; 102*f* another exhaust port; 103 a radiating portion; 104 an endothermic portion; 105 spacers; 106 a heat exchange unit; 107 side plates; 110 partition plate; 111 fins; 112 heat pipes; 113 a group of heat pipes; 114 a partition plate; and 115 partition walls.

In FIGS. 8 through 12, reference numeral 201 indicates a heat exchange portion; 202 a casing; 202*a* a hollow cylindrical body; 202*b* a partition plate; 202*c* an exhaust port; 203 a radiating portion; 204 an heat receiving portion; 205 spacers; 206, $\mathbf{206}_1$, $\mathbf{206}_2$, . . . $\mathbf{206}_{12}$ heat exchange units; 210 partition plates; 212 heat pipes; 213 the tube members; 214 air or gas flow guide plates; 215 a partition plate; 216 partition walls; 217 ducts, and 219 connecting rods.

FIGS. 15(A) and (B), FIGS. 16(A) and (B), FIGS. 17(A) and (B) and FIGS. 18(A) and (B) are schematic illustrations of different examples of modification of the heat exchanger shown in FIG. 13. In FIGS. 13 through 18, a reference numeral 301 indicates a heat exchange portion; 302 a casing; 302*a* a hollow cylindrical body; 302*b* a partition plate; 302*c* an exhaust port; 302*d* an intake port; 302*e* another intake port; 302*f* another exhaust port; 303*a* radiating portion; 304 a heat receiving portion; 305 spacers; 306, $\mathbf{306}_1$, $\mathbf{306}_2$, . . . $\mathbf{306}_{12}$ heat exchange units; 310 partition plates; 312 heat pipes; 313 pipe group; 314 a partition plate; 315 partition walls; 316 rectifiers; and 317 ducts.

FIG. 33 is a partially cutaway plan view showing a cylindrical heat-pipe type heat exchanger provided with a heat exchange portion wherein heat pipes of different diameters are arranged.

In FIGS. 19 through 25, a reference numeral 401 indicates a heat exchange portion; 402 a casing; 402*a* hollow cylindrical body; 402*b* a partition plate; 402*c* an exhaust port; 402*d* an intake port; 402*e* another intake port; 402*f* another exhaust port; 403 a radiating portion; 404 a heat receiving portion; 405 spacers; 406, $\mathbf{406}_1$, $\mathbf{406}_2$, . . . $\mathbf{406}_{12}$ heat exchange units; 410 partition plates; 412 heat pipes; 413 a pipe group; 415 partition walls; 416 ducts; and 417 air or gas flow shield plates.

In FIGS. 26 and 27, a reference numeral 501 indicates a heat exchange portion; 502 a casing; 502*a* and 502*d* exhaust ports; 502*b* and 502*c* intake ports; 503 a radiating portion; 504 an heat receiving portion; 505 an exhaust duct; 507, $\mathbf{507}_1$, $\mathbf{507}_2$, . . . $\mathbf{507}_{12}$ heat exchange units; 511*a* and 511*b* partition plates; 513 heat pipes; 514 a pipe group; 515 partition walls; and 516 rectifiers.

DETAILED DESCRIPTION OF THE INVENTION

This invention relates to a cylindrical type heat exchanger wherein a heat exchange portion is formed in a cylindrical or polygonal tubular shape using heat pipes for reduction in size and improvement in heat exchange efficiency.

Heat exchange of the type using heat pipes is generally carried out in the following manner: A working liquid is enclosed in metal pipes which are sealed under reduced pressure; a porous layer called wick is provided on the inner face of each of the metal pipes; one end of the pipe is arranged to function as heat receiving portion where the working liquid is caused to absorb heat by heat exchange with a high temperature gas and thus becomes vapor; the vapor moves to a radiating portion located at the other end portion of the heat pipe; the vapor is then caused to condense through heat exchange with a low temperature gas and the condensed liquid returns to the heat receiving portion. Impartment of heat is carried out by means of latent heat utilizing the phase transition of the operating liquid from liquid to gas and transmission is effected in the form of steam.

Heat exchangers of the type using such heat pipes have heretofore been in the form of a gas-to-gas heat exchanger wherein the heat of a waste gas is used for heating a low temperature gas such as air.

Figure 1:
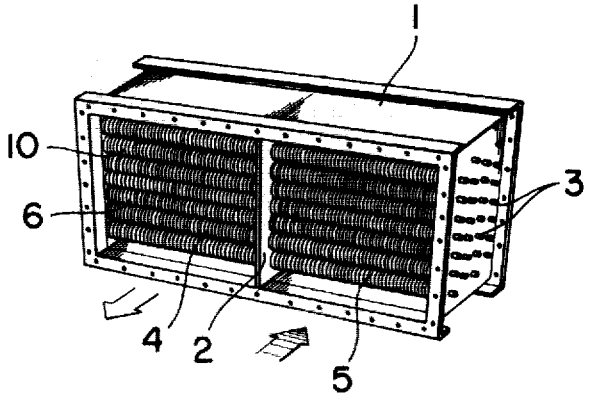
FIG. 1 PRIOR ART
FIG. 1 is a perspective view showing a conventional heat exchanger.

This type of conventional heat-pipe type heat exchangers include, for example, a heat exchanger of construction as shown in FIG. 1. In this case, a partition plate 2 is provided inside a rectangular casing to divide the inside thereof. A plurality of heat pipes 3 provided with fins are arranged to pierce through the partition plate to form a heat exchange portion 4. One side of the heat pipe group 3 is arranged to be a radiating portion 5 through which a low temperature gas to be heated is allowed to flow while the other side is arranged to be a heat receiving portion 6 through which a high temperature gas is allowed to flow.

However, since a heat exchanger of such construction is arranged in a rectangular form which is long in the horizontal direction, the size of the heat exchanger becomes large requiring a greater space in the direction of its width in order to carry out heat exchange in sufficiently great quantity. Besides, such construction causes uneven flow of gas and makes it impossible to attain high heat exchange efficiency.

Further, in another example of the conventional heat-pipe type gas-to-gas heat exchangers which heat a low temperature gas by the recovered heat of a waste gas, a partition plate is provided inside a rectangular casing to divide the inside thereof; and a plurality of heat pipes are arranged to pierce through the partition plate to form a heat exchange portion; the upper part of the heat exchange portion thus formed is arranged to be a radiating portion through which a low temperature gas is allowed to flow while the lower part thereof is arranged to be a heat receiving portion through which a high temperature gas is allowed to flow. The size of such a heat exchanger, however, is limited in the direction of thickness to prevent the flow resistance of gas from becoming excessively large. Therefore, in order to carry out heat exchange in sufficiently great quantity, the heat exchanger must be constructed in a flat form, which then makes uniform gas supply difficult. Such limitation also necessitiates increase in the size of the heat exchanger.

The first object of this invention is to provide a cylindrical heat exchanger which permits reduction in size and increase in heat exchange efficiency, the heat exchanger being arranged in the following manner: Plurality of heat pipes with fins are arranged in an annular configuration, piercing through a horizontal partition plate, to form a cylindrical or polygonal tubular heat exchange portion; the heat exchange portion is housed in a hollow disc-shaped casing which has a helical circumferential wall with an annular partition plate provided therein; an exhaust port is provided in the upper part of the end of the helical form of the casing and an intake port in the lower part thereof; and in the upper side of the casing is formed another intake port which communicates with a cylindrical hollow part formed in the heat exchange portion while in the lower side of the casing is formed another exhaust port. With these ports provided, the upper part of the heat exchange portion is arranged to function as radiating portion which allows a low temperature gas to flow therethrough and the lower part to function as heat receiving portion which allows a high temperature gas to flow therethrough.

The second object of this invention is to provide a polygonal tubular heat exchanger which increases heat exchange efficiency with channelling or uneven flow of gas prevented by arranging partition walls to separate heat pipe groups from each other and by regulary spacing heat pipes in each group, the heat exchanger being arranged in the following manner: In a cylindrical heat exchanger having a cylindrical heat exchange portion which is formed by vertically arranging many heat pipes to pierce through a horizontal partition plate is enclosed in a hollow disc shaped casing which has a circumferential wall formed into a helical shape with an annular partition plate horizontally arranged therein, with a radiating portion which allows a low temperature gas to be heated to flow therethrough being formed in the upper part of the heat exchange portion above the partition plate and a heat receiving portion which allows a high temperature gas to flow therethrough being formed in the lower part of the heat exchange portion below the partition plate, the heat exchange portion is formed into a polygonal tubular shape by radially arranging a plurality of partition walls in the peripheral portion of the horizontal polygonal or circular partition plate perpendicularly to both the upper and lower faces of the plate to divide its peripheral portion into divisions; and by arranging many heat pipes at regular spacing within each of the divisions of the partition plate in such a manner as to constitute the tube members of a polygonal tubular configuration.

The third object of this invention is to provide a cylindrical heat-pipe type heat exchanger which solves a problem that heat exchange efficiency is lowered by a large pressure drop taking place due to a turbulent flow caused inside the duct when the gas in the radiating portion moving from the middle part of the heat exchange portion toward the outside after completion of heat exchange comes to almost perpendicularly impinge upon the gas which is circulating inside the duct, the heat exchanger being arranged as follows: In a cylindrical heat-pipe type heat exchanger having a cylindrical heat exchange portion consisting of a plurality of heat pipes vertically arranged in an annular configuration to pierce through a polygonal or disc-shaped partition plate with the heat exchange portion being placed inside a casing which is formed by a hollow cylindrical body having its circumferential wall face shaped in a helical form with the end face of the helical form left opened and having an annular partition plate provided horizontally inside the circumferential wall to form ducts above and below the annular partition plate, the upper part of the heat exchange portion serving as a radiating portion which allows a low temperature gas to flow there and the lower part thereof serving as a heat receiving portion which allows a high temperature gas to flow there, a plurality of slanting air flow guide plates are arranged on the outer circumferential face of the above stated cylindrical heat exchange portion on the side of the radiating portion, the air flow guide tilting toward the open end of the helical form in such a manner as to prevent occurrence of a turbulent flow.

The fourth object of this invention is to provide a cylindrical heat-pipe type heat exchanger which ensures almost uniform flows of gas, the heat exchanger being arranged as follows: In the cylindrical heat-pipe type heat exchanger previously proposed by the present inventors having a cylindrical heat exchange portion disposed in a helical casing, rectifiers of an approximately circular conic shape are provided both on the upper and lower faces of a partition plate disposed in the hollow part of the cylindrical heat exchange portion in such a manner as to cause gas to flow almost uniformly. Uneven gas flow is caused in the following manner: A low temperature gas which is blown from the side of the radiating portion into the hollow part of the heat exchange portion directly hits the partition plate to produce a turbulent flow. This causes not only a pressure loss but also channelling or uneven flow thus making even distribution of flow impossible. Further, a pressure loss becomes greater at the parts of the heat exchange portion located deeper in the helical form of the casing as these parts are affected by the wall face resistance in the duct. As a result of this, gas supply to the deeper parts of the radiating portion located deeper in the helical form becomes insufficient while gas discharge on the side of the heat receiving portion becomes also insufficient. Thus, there takes place channelling or uneven flow of gas uneven gas flow as a whole. Such a problem is solved by the provision of the above stated rectifiers in accordance with this invention.

The fifth object of this invention is to provide a cylindrical heat-pipe type heat exchanger which makes almost uniform the rate of gas flow passing its cylindrical heat exchange portion throughout the whole circumferential area thereof for improvement in heat exchange efficiency, the heat exchanger being arranged as follows: In the cylindrical heat-pipe type heat exchanger previously proposed by the present inventors having the cylindrical heat exchange portion disposed in a helically shaped casing, the cylindrical heat exchange portion is arranged in such a manner that pressure drop gradually decreases as distance increases from the open end of the helical casing.

The present inventors have previously proposed a cylindrical heat-pipe type heat exchanger wherein there is provided a casing having a helically shaped circumferential wall face forming a hollow cylindrical body with the end face of the helical form provided with an opening while upper and lower ducts are formed with an annular partition plate horizontally disposed inside the circumferential wall; in the casing is provided a cylindrical heat exchange portion comprising a plurality of heat pipes vertically arranged to pierce through a polygonal or circular partition plate; and the upper part of the heat exchange portion is arranged to serve as a radiating portion which allows a low temperature gas to flow therethrough while the lower part of the heat exchange portion is arranged to serve as a heat receiving portion which allows a high temperature gas to flow tehrethrough. Although the previous heat exchanger permits reduction in size thereof, the rate of gas flow passing through the heat exchange portion becomes uneven. The uneven flow rate has been making it difficult to attain sufficient heat exchanger efficiency. This problem has been caused by the fact that the heat pipes are not arranged to regularly cover the whole circumferential area of the cylindrical heat exchange portion and that the heat exchange portion is not placed inside a helically shaped casing. The lack of such arrangement has been causing a problem that the wall face resistance of the ducts causes a greater pressure loss in areas deeper inside the helical form and, as a result, the rate of gas flow becomes uneven. This problem is solved by this invention.

The sixth object of this invention is to provide a cylindrical heat-pipe type air preheater wherein a cylindrical heat exchange portion is formed by arranging a plurality of heat pipes to perpendicularly pierce through a poligonal or disc shaped partition plate which is horizontally disposed with the upper part of the heat exchange portion above the plate arranged to serve as a radiating portion and the lower part thereof below the plate arranged to serve as a heat receiving portion; the heat exchange portion formed in this manner is disposed inside a casing which has an exhaust port in its upper side and an intake port in its lower side with an opening provided in its circumferential side left open; and the upper open circumferential part of the casing on the side of the radiating portion is used as intake port for taking in air while its lower circumferential wall of the casing is shaped into a helical form to surround the lower heat receiving portion with an opening provided in the end of the helical form left open to serve as exhaust port for a high temperature gas. The present inventors have previously proposed a cylindrical heat-pipe type air preheater of the type having heat pipes arranged to pierce through a partition plate in an annular configuration. In the previously proposed air preheater, a casing is formed with a hollow cylindrical body having its circumferential wall shaped into a helical form, with an opening provided at the end of the helical form and with an annular partition plate horizontally disposed inside the circumferential wall face to form upper and lower ducts therein; while there are provided an intake port in the upper side of the hollow cylindrical body and an exhaust port in the lower side thereof; and, inside the casing, there is installed a cylindrical heat exchange portion which is composed of a plurality of heat pipes vertically arranged to pierce through the partition plate in an annular configuration. This air preheater permits reduction in the size thereof. The previously proposed air preheater, however, has various shortcomings including: Low temperature air is supplied to the heat exchange portion coming through the upper duct with the air arranged to spirally rotate on its way to the heat exchange portion. Then, this causes pressure loss due to turbulent flow resistance and the wall face resistance of the duct. As a result, the flow of gas becomes uneven. Accordingly, it is difficult to attain sufficient heat exchange efficiency. Also, this necessitates the use of a larger blower for air supply. This shortcoming of the previously proposed air preheater is eliminated by this invention.

Figure 2:
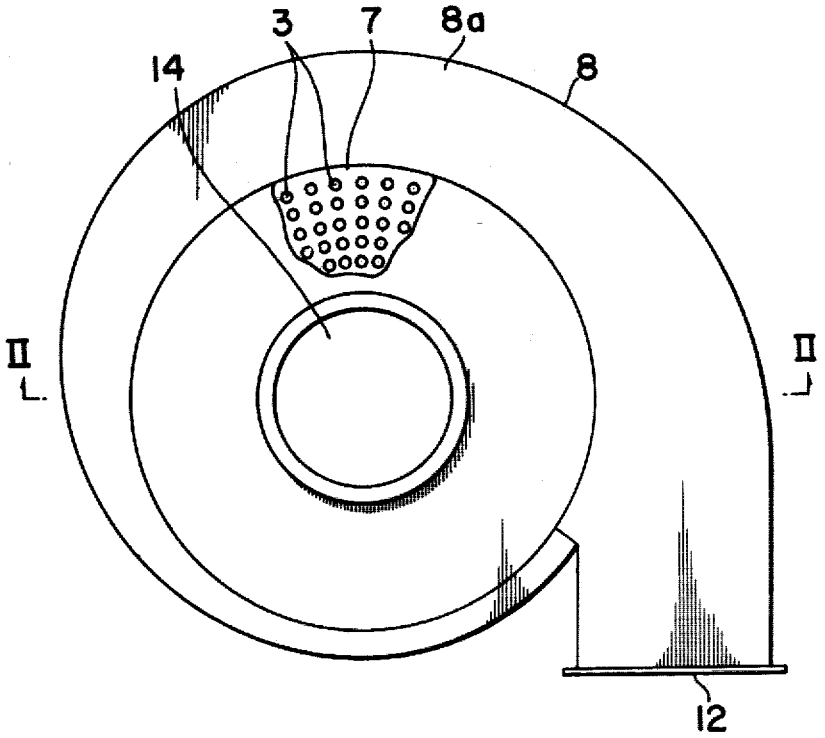
FIG. 2 is a partially cutaway plan view showing an embodiment (Example 1) of this invention
Figure 3:
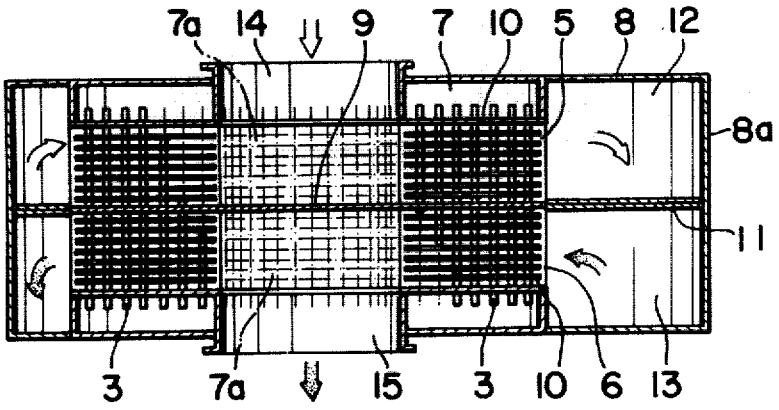
FIG. 3 is a sectional view taken across a line III—III shown in FIG. 2.

These and other objects and advantages of the invention will become more apparent from the following description of embodiments thereof:

EXAMPLE 1 (FIGS. 2 and 3)

Referring to FIGS. 2 and 3, a reference numeral 7 indicates a cylindrical heat exchange portion and a numeral 8 a hollow cylindrical casing which houses the heat exchange portion 7 therein with its circumferential wall being shaped into a helical form. The heat exchange portion is divided into an upper part and a lower part with a disc shaped partition plate 9, the upper part being used as radiating portion and the lower part as heat receiving portion.

The heat exchange portion is formed into a cylindrical shape by arranging a plurality of heat pipes 3 provided with fins 10 to pierce through the disc shaped partition plate 9 which is horizontally disposed, the heat pipes being arranged in an annular configuration. As for the annular configuration of the heat pipes 3 piercing through the partition plate 9, these pipes may be arranged into any configurations leaving the middle part of the plate 9 unpierced, such as a radial, concentric circle or helical configuration.

The casing 8 which houses the heat exchange portion 7 therein is provided with an annular partition plate 11 which is horizontally disposed inside the casing body 8*a* which is shaped into a hollow cylindrical form with its circumferential wall shaped into a helical form. The open end of the helical form of the circumferential wall of the hollow cylindrical casing is divided into upper and lower parts by the annular partition plate 11. The upper part of the open end is formed to serve as exhaust port 12 from which a heated low temperature gas is discharged while the lower part is formed to serve as intake port from which a high temperature gas such as a hot waste gas or the like is taken in. Further, in the upper side of the casing 8 which is shaped into a hollow cylindrical form, there is provided an intake port 14 which communicates with a cylindrical hollow part 7*a* of the heat exchange portion 7 for allowing a low temperature gas to flow therein. An exhaust port 15 through which a high temperature gas taken in from the above stated intake port 13 is discharged after heat exchange is provided in the lower side of the casing 8.

The cylindrical heat exchanger of the above described construction operates in the following manner: Through the intake port 14 formed in the upper side of the casing 8, a low temperature gas is introduced into the radiating portion 5 while a high temperature gas is taken into the heat receiving portion 6 through the intake port 13 which is formed in the lower side of the casing 8. Then while helically revolving inside the casing 8, the high temperature gas heats the heat receiving portion 6 of the heat exchange portion 7 formed by the heat pipes 3. After the heat is discharged through heat exchange at the heat receiving portion, the high temperature gas passes through the cylindrical hollow part 7*a* and is discharged from the exhaust port 15 provided in the lower side of the casing 8. On the other hand, by the heat transport action of the heat pipes 3, the absorbed heat is rapidly transmitted to the radiating portion 5 of the heat exchange portion and is subjected to heat exchange there with the low temperature gas taken in through the intake port 14 to heat the latter. The low temperature gas helically revolves inside the casing to contact further with the heat pipes 3 inside the radiating portion for through heat exchange. Then, the heated gas is discharged to the outside through the exhaust port 12 provided in the upper part of the end of the casing 8.

As described in the foregoing, in the present embodiment example, heat pipes of excellent heat transpartation are arranged in an annular configuration to form a heat exchange portion of the cylindrical heat exchanger. This permits not only reduction in the size of the heat exchanger but also through heat exchange because the heat exchange portion is housed in a hollow cylindrical casing having its circumferential wall face shaped into a helical form and this causes the low temperature gas and the high temperature gas to make helical revolutions in contact with the cylindrical heat exchange portion formed by the heat pipes. The heat exchanger is therefore highly advantageous particularly when applied to recovery of waste heat in large quantity.

EXAMPLE 2 (FIGS. 4 through 7)

Figure 6:
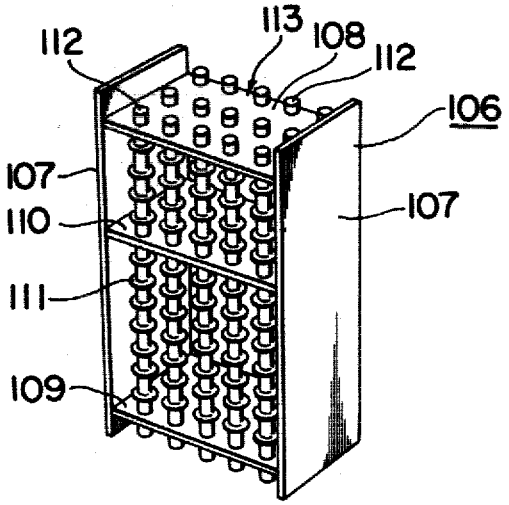
Figure 7A:
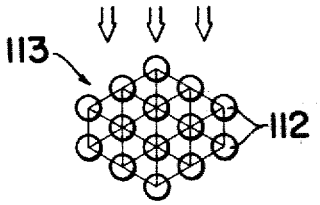
FIGS. 7(A) through (D) are schematic views showing different configurations of the heat pipes shown in FIG. 6.
Figure 7C:
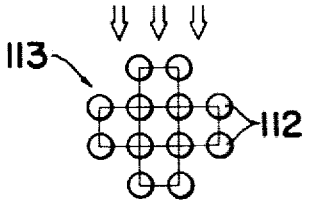
Figure 7B:
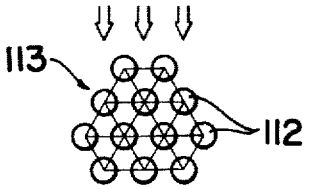
Figure 7D:
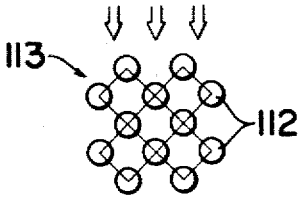

In FIGS. 4–7, a reference numeral 101 indicates a heat exchange portion shaped into a polygonal tubular form; 102 indicates a casing provided for housing the heat exchange portion 101 therein; 103 indicates a radiating portion where a low temperature gas to be heated is allowed to pass; and 104 indicates a heat receiving portion which is provided below the radiating portion 103 for allowing a high temperature gas to pass through there. The heat exchange portion 101 is composed of 12 heat exchange units annularly arranged in a polygonal tubular form through spacers 105 of a triangular sectional shape formed at an angle of 30 degrees. As shown in FIG. 6, each of the heat exchange units 106 is formed with rectangular side plates 107, a rectangular upper plate 108, a bottom plate 109 and a partition plate 110 which are assembled into a frame having its front and rear sides left open and with a plurality of heat pipes which are provided with fins 111 and which are arranged to pierce through the partition plate 110 at equal spacing to form a square pillar like shape as a group 113. Referring to FIG. 7, the equally spaced arrangement of the heat pipes 112 may be made by equilateral triangular arrangement as shown in FIGS. 7(A) or (B) or by square arrangement as shown in FIGS. 7(C) or (D). What is shown in FIGS. 7(B) and (D) is alterate column arrangement relative to the direction in which the gas flows.

Figure 4:
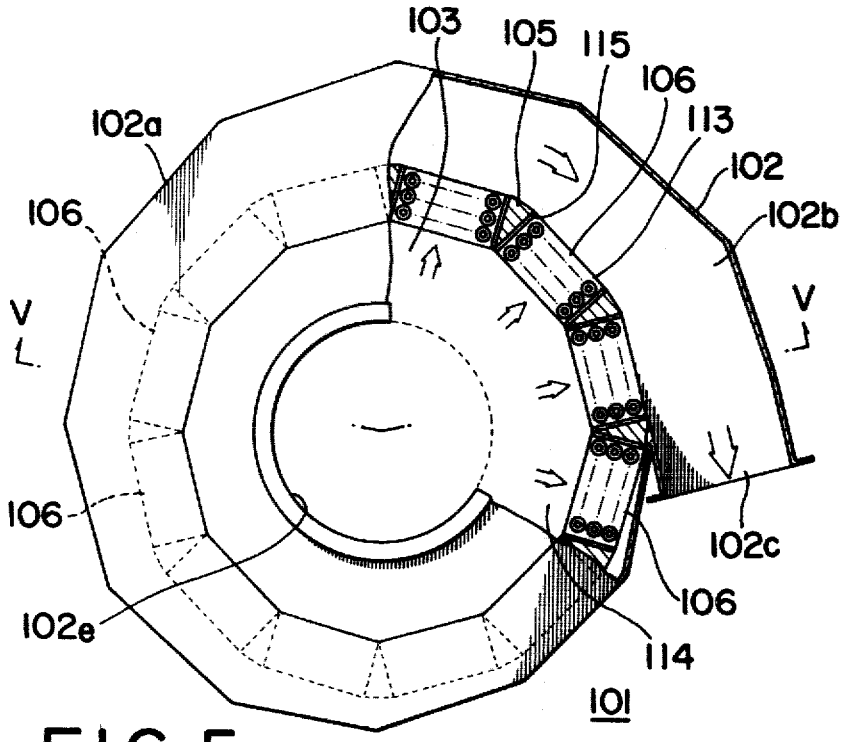
FIG. 4 is a partially cutaway plan view showing a cylindrical heat exchanger and another embodiment (Example 2) of this invention.
Figure 5:
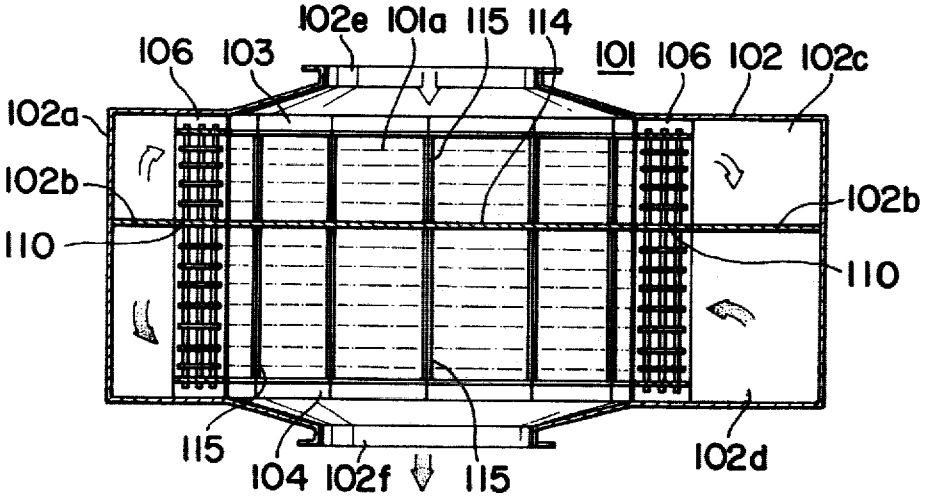
FIG. 5 is a sectional view showing a heat exchange unit constituting a heat exchange portion shown in FIG. 4.

As shown in FIG. 4, these heat exchange units are arranged through the spacers 105 one after another in the peripheral area of the partition plate 114. The side plates 107 are thus arranged to serve as an radial array of partition walls 115 with each rectangular prism of pipe members 113 separated from others thereby to form a polygonal tubular heat exchange portion 101.

In the casing 102 which houses the heat exchange portion 101, an annular partition plate 102*b* is horizontally disposed in the middle part inside the hollow cylindrical casing body 102*a* which has its circumferential wall shaped in a helical form. Further, at the open end of the helical form of the hollow cylindrical casing 102, there is provided an exhaust port 102*c* above the partition plate 102*b* for discharging a low temperature gas such as air after it has been heated while, below the partition plate at the open end, there is provided an intake port 102*d* for introducing a high temperature gas such as a waste heat gas. Further, in the upper side of the hollow cylindrical casing 102, there is provided an intake port 102*e* which communicates with the hollow part 101*a* of the heat exchange portion 101 for introducing a low temperature gas therethrough. In the lower side of the casing, there is provided an exhaust port 102*f* from which the high temperature gas introduced through the intake port 102*d* provided at the end of the helical form is discharged after heat exchange.

The cylindrical heat exchanger constructed in the above-mentioned manner operates as follows: A low temperature gas is taken into the radiating portion 103 through the intake port 102*e* provided in the upper side of the casing 102. At the same time, a high temperature gas is taken into the heat receiving portion 104 through the intake port 102*d* provided in the lower side of the casing 102. The high temperature gas which is blown into the casing 102 then moves forward while helically revolving along the circumferential wall face of the casing and comes to pass the heat pipe groups 113 separated from each other by the partition walls 115 and arranged into a square pillar-like shape. The high temperature gas is subjected to heat exchange there and is cooled down before it reaches the middle part of the heat exchange portion 101. The cooled gas is then passed through the exhaust port 102*f* provided in the lower side of the casing 102 to be discharged to the outside through a duct.

In this case, the radial array of the partition walls 115 causes the high temperature gas to uniformly flow into each part separated by the partition walls 115. In addition to this advantage, the finned heat pipes 112 are regularly spaced and regularly arranged in a triangular or square arrangement to ensure that the high temperature gas is subjected to heat exchange at a high efficiency.

Each heat pipe 112 is prepared by putting an working liquid in a metal tube which is sealed under reduced pressure. The heat absorbed through heat exchange with the high temperature gas is quickly transported to the radiating portion 103 side where heat exchange is made with the low temperature gas taken in from the intake port 102 to heat the low temperature gas. In this case, the low temperature gas which flows from the intake port 102*e* provided in the upper side of the casing 102 to the middle part of the heat exchange portion 101 is also caused by the radial array of the partition walls 115 to uniformly flow into each part divided by the partition walls in the same manner as in the heat receiving portion 104. Then, the low temperature gas is thoroughly heated while passing through the groups 113 of the pipes regularly spaced and, after heating, revolves along the helically formed circumferential wall face to be discharged to the outside through the exhaust port 102*c*. Such a prefabrication type cylindrical heat exchanger consisting of the heat exchange units 106 assembled into a polygonal tubular form as shown in FIG. 6 is not limited to a dodecagonal form and may be assembled into other suitable forms as desired. Such assembling greatly facilitates the manufacture of a heat exchanger of a large capacity.

In the above described heat exchanger, the spacers 105 which have a triangular sectional shape are used for insertion between the heat exchange units 106. However, such spacer may be dispensed with and the units may be connected to each other through a suitable connecting means without such spacers.

Further, the present invention is not limited to the above-stated prefabricated type formed by assembling the heat exchange units 106. The partition plates 110 and 114 may be replaced with a single piece of polygonal or circular plate; a radial array of a plurality of partition walls 115 may be perpendicularly disposed on the upper and lower faces of the peripheral area of such a partition plate; and, in each part divided by the partition walls 115, a plurality of finned heat pipes 112 may be equally spaced to form a pipe group 113 in a square pillar-like shape in such a manner as to have a cylindrical heat exchange portion 101 presenting about the same finished appearance as the one shown in FIG. 4.

In accordance with this invention, the fins are not limited to radial fins and plate fins are also usable. Further, heat pipes having no fins may be used.

As described in the foregoing, in the cylindrical heat exchanger of the present embodiment example, the partition walls which are radially arranged in the peripheral area of the partition plate serve to ensure that the gas led into the heat exchanger flows uniformly to each part. Unlike the conventional cylindrical type heat exchangers, no channelling or uneven flow takes place. Besides, in each part divided by the partition walls, heat pipes with fins are equally spaced and arranged to form a pipe group of a square pillar-like configuration piercing through a partition plate. The gas which flows into the heat exchanger is caused to uniformly impinge on the heat pipes, so that the load on each heat pipe is equalized. These two advantageous effects serve to greatly enhance the heat exchange efficiency over the conventional heat exchangers. Further, since the heat pipes in the present embodiment are regularly arranged in each group and the gas uniformly impinges on the pipe groups, a designing can be easily done thus obviating the necessity of taking a safety factor more than necessary. This permits reduction in the size of the heat exchanger required. Since the present embodiment permits prefabrication, the manufacturing processes, particularly those for large scaled heat exchangers, can be greatly facilitated. Thus, the invented heat exchanger has many advantages that are extremely valuable for industrial applications.

EXAMPLE 3 (FIGS. 8 through 12)

Referring to FIGS. 8 through 12, a reference numeral 201 indicates a heat exchange portion; 202 a casing which houses the heat exchange portion 201; 203 a radiating portion through which a low temperature gas to be heated is allowed to flow; and 204 an heat receiving portion which is provided below the radiating portion to allow a high temperature gas to flow therethrough.

Figure 10:
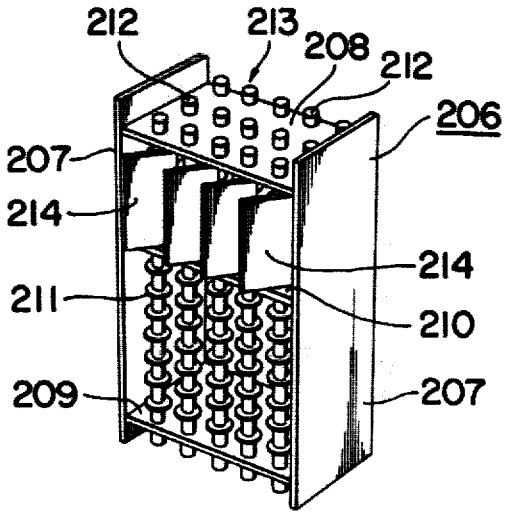
FIG. 10 is a perspctive view showing a heat exchange unit constituting a heat exchange portion shown in FIG. 8.

The heat exchange portion 201 is composed of 12 heat exchange units $\mathbf{206}_1$, $\mathbf{206}_2$, . . . $\mathbf{206}_{12}$ which are annularly arranged at an angle of 30 degrees through spacers 205 each spacer being formed to have a triangular sectional shape. The heat exchange portion 201 thus presents a polygonal tubular shape divided into a plurality of blocks. As shown in FIG. 10, each heat exchange unit 206 comprises a frame which is open on the front and rear sides and is composed of side plates 207, an upper plate 208, a bottom plate 209 and a partition plate 210. Then, a square tubular shaped group 213 of heat pipes 212 is formed by arranging a plurality of heat pipes 212 to pierce, equally spaced, through the partition plate 210. In a space provided for the radiating portion 203 between the upper plate 208 and the partition plate 210, a plurality of air or gas flow guide plates 214 are disposed, perpendicular to these plates 208 and 210 and tilting against the side plates 207.

With each heat exchange unit formed as described above, the heat exchange units $\mathbf{206}_1$, $\mathbf{206}_2$, . . . $\mathbf{206}_{12}$ are arranged through the spacers 205 in the peripheral portion of a polygonal partition plate 215 with the air flow guide plates 214 arranged to be tilting toward the open end of the helical casing 202. With these heat exchange units assembled in this manner, the side plates 207 are radially arrayed to serve as partition walls 216 and each block which is separated from others by the partition walls 216 is formed into a square pillar-like configuration of a pipe group 213 to constitute the polygonal tubular heat exchange portion 201.

The circumferential wall of the casing 202 which houses the heat exchange portion 201 is shaped in a helical form to have a hollow cylindrical body 202*a* with the end of the helical form left open. An annular partition plate 202b is horizontally provided in the middle part of the inside of the circumferential wall to form ducts 217 above and below the partition plate. The upper part of the open end of the helical form of the casing 202 divided by the partition plate 202b is used as an exhaust port 202c for allowing a low temperature gas such as air to be discharged therethrough after it has been heated. The lower part of the open end is used as an intake port 202d for taking in a high temperature gas such as a waste gas. In the upper side of the casing 202 is provided an intake port 202e which communicates with a hollow part 201a of the heat exchange portion 201 for introducing a low temperature gas therethrough. In the lower side of the casing is provided an exhaust port 202f for allowing the high temperature gas which is taken in from the intake port 202d provided at the end of the helical form to be discharged therefrom through the hollow part 201b after heat exchange has been accomplished.

The cylindrical heat-pipe type heat exchanger of the above stated construction operates in the following manner: A low temperature gas is introduced to the inside of the radiating portion 203 from the intake port 202e provided in the upper side of the casing 202 while a high temperature gas is introduced to the inside of the heat receiving portion 204 from the intake port 202d provided in the lower part of the end of the casing 202. The high temperature gas which is blown into the heat receiving portion helically revolves while moving forward along the circumferential wall face inside the duct 217 passing each part divided by the partition walls 216 and the heat pipe groups 213 of a square pillar-like configuration to be subjected to heat exchange and is cooled there before it reaches the middle part of the heat exchange portion 201. Then, the high temperature gas is discharged to the outside from the exhaust port 202f provided in the lower side of the casing 202.

Each of the heat pipes 212 is prepared by putting a working liquid in a metal tube which is sealed under reduced pressure. The heat absorbed through heat exchange is quickly transported to the side of the radiating portion 203 where the transported heat is subjected to heat exchange with the low temperature gas introduced from the intake port 202e to heat the latter there. In this case, the low temperature gas which flows into the middle part of the heat exchange portion 201 from the intake port 202e provided in the upper side of the casing 202 is allowed to uniformly flow into the blocks divided by the radial array of the partition walls 216 for heat exchange in the same manner as in the heat receiving portion 204. The gas which has been heated through heat exchange is blown out into the duct 217 by the air flow guide plates 214 toward the open end of the helical form of the casing. The flow of the gas blown out aslant by the guide plate 214 is in the same direction as the gas which is revolving inside the duct 217 toward the open end of the helical casing to prevent occurrence of a turbulent flow. This arrangement, therefore, reduces pressure loss caused by a turbulent flow to ensure improvement in heat exchange efficiency.

Further, the heat exchange units 206 can be prepared beforehand as shown in FIG. 10. Then, they can be easily assembled into a polygonal turbular heat exchanger 201 of a prefabrication type. Such a process is particularly advantageous for reduction in size in the manufacture of a heat exchanger of a large scale heat exchange capacity.

Figure 11:
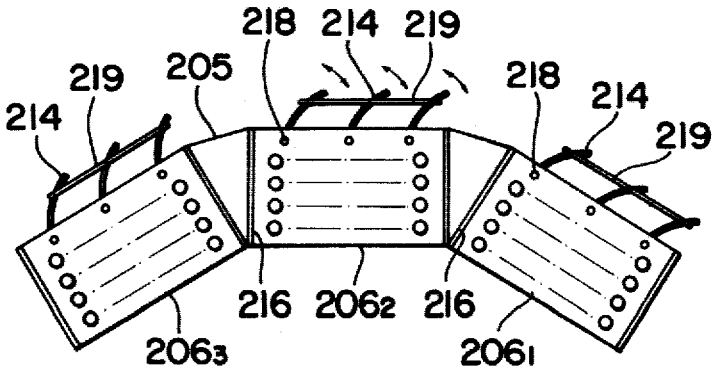
FIG. 11 is a plan view showing essential parts of the heat exchange portion to which air or gas flow guide plates are attached in a freely rotatable fashion.

The heat exchange portion 201 is not limited to the dodecagonal form but any other forms may be selected as desired. In the above description, the heat exchange units 206 are arranged through the spacers 205. However, such spacers may be dispensed with and the units may be connected to each other through some suitable connecting means. The air flow guide plates 214 are not limited to stationary plates and, as shown in FIG. 11, the guide plates may be rotatably attached to the heat exchange units through shafts 218 with these guide plates 214 connected to each other by connecting rods 219 in such a manner as to make their slanting angle adjustable.

Figure 12:
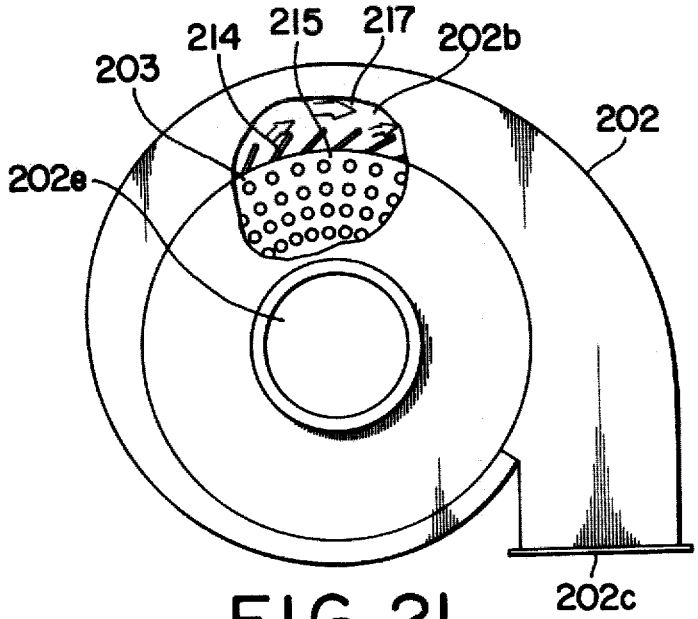
FIG. 12 is a partially cutaway plan view showing a cylindrical heat-pipe type heat exchanger wherein a heat exchange portion is provided with no partition wall.

FIG. 12 illustrates another modification example wherein there is provided no partition wall 216. A cylindrical heat exchange portion 201 is formed by annularly arranging a plurality of heat pipes 212 to pierce through a disc shaped partition plate 215. On the circumferential part of the radiating portion 203 of the heat exchange portion 201 arranged to allow a low temperature gas to flow therethrough, there are provided a plurality of flow guide plates 214 which are tilting toward the open end of the helical casing.

The following is detailed description of an experiment conducted with regard to the present embodiment.

Figure 8:
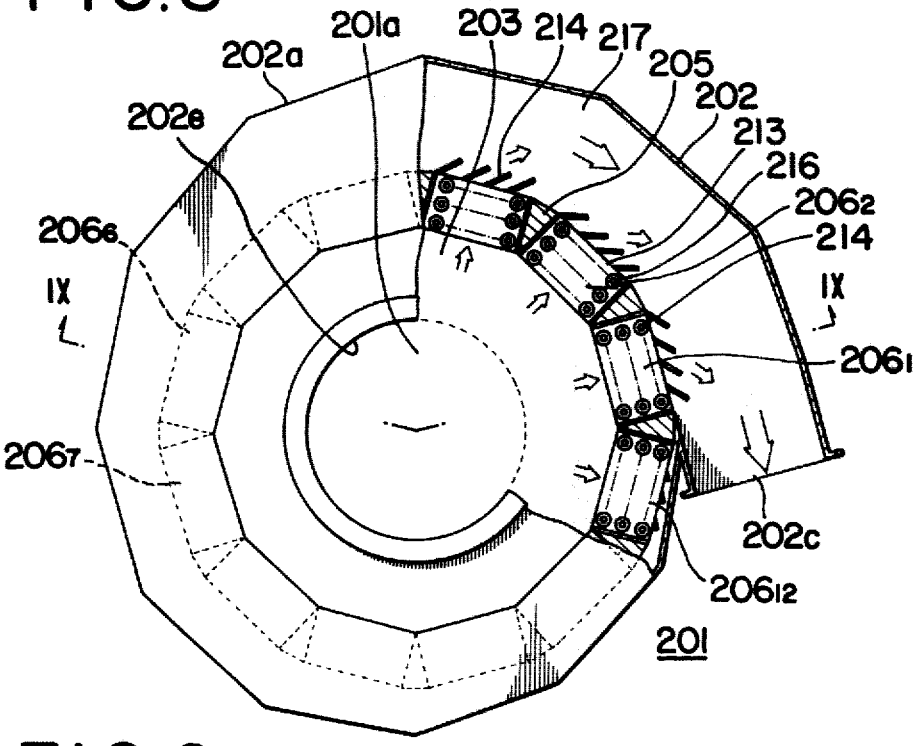
FIG. 8 is a partially cutaway plan view showing a cylindrical heat-pipe type heat exchanger as a further embodiment (Example 3).
Figure 9:
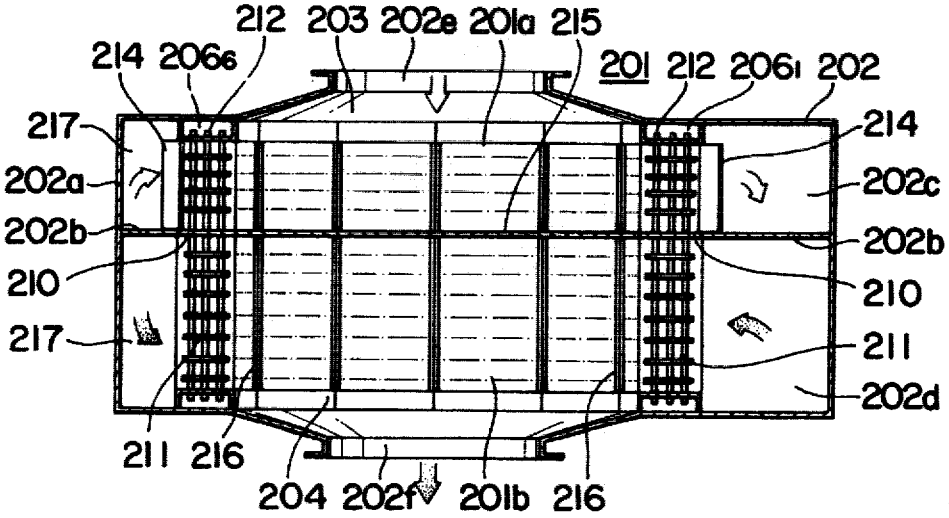
FIG. 9 is a sectional view taken across a line IX—IX shown in FIG. 8.

Each of the heat pipes 212 was manufactured using copper for an inner tube and carbon steel for an outer tube to obtain a double tube measuring 25.4 mm in outside dimension and 3800 mm in length. Then, carbon steel fins each measuring 52.4 mm in outside diameter were attached to the outside of the double tube at the fin pitch of 3.5 mm. As working liquid, a heat transfer diphenyl oil was placed inside the double tube and the tube is sealed. A heat exchange unit 206 was assembled by having 288 pieces of the heat pipe 212 piercing through a partition plate 210 as shown in FIG. 10 in 24 rows × 12 files. In the upper part of these heat pipes (the radiating portion side), 4 flow guide plates 214 were attached at a tilting angle of 40 degrees each guide plate measuring 2.5 mm in thickness, 150 mm in width and 1400 mm in length. A total of 12 heat exchange units $\mathbf{206}_1$, $\mathbf{206}_2$, . . . $\mathbf{206}_{12}$ which were prepared in the above stated manner were arranged on the circumferential side of a dodecagonal partition plate 215 as shown in FIG. 8 to form a dodecagonal tubular heat exchange portion 201 measuring 6960 mm in outside diameter. The heat exchange portion 201 was placed inside a helical casing 202 to form a cylindrical, heat-pipe type heat exchanger.

Using this heat exchanger, heat exchange between a high temperature gas and a low temperature gas was carried out under the conditions shown in Table 1. The quantity of heat exchange performed through this experiment was $9.6 \times 10^6$ Kcal/h.

TABLE 1

| | Endothermic portion side (high temp.) | Radiating portion side (low temperature) |
|---|---|---|
| Entrance temperature: | 250° C. | 20° C. |
| Exit temperature: | 153° C. | 170° C. |
| Quantity of flow: | 325,000 $Nm^3/h$ | 210,000 $Nm^3/h$ |
| Total pressure loss: | 36 mm Aq | 28 mm Aq |

For comparison with the present invention, the same experiment was also conducted using a cylindrical heat-pipe type heat exchanger which is not provided with the flow guide plates 214. The quantity of heat exchange measured was $5.65\times10^6$ Kcal/h. This indicates that the heat exchange efficiency is increased by about 70% while the pressure loss is decreased by about 30% in accordance with the invention.

As mentioned in the foregoing, with the cylindrical heat-pipe type heat exchanger of the present embodiment example employed, the turbulent flow which takes place in the duct on the side of the radiating portion is held to a minimal degree to decrease pressure loss and thus to enhance the heat exchange efficiency. Besides, this embodiment permits reduction in the sizes of a blower and ducts.

EXAMPLE 4 (FIGS. 13–18)

In FIGS. 13 through 18, a reference numeral 301 indicates a heat exchange portion; 302 a casing which houses the heat exchange portion 301; 303 a radiating portion where a low temperature gas to be heated is allowed to flow through there; 304 a heat receiving portion which is provided below the radiating portion 303 to allow a high temperature gas to flow there.

The heat exchange portion 301 is formed in a polygonal tubular form by annularly arranging 12 heat exchange units $\mathbf{306}_1$, $\mathbf{306}_2$, . . . $\mathbf{306}_{12}$ through spacers 305 of a triangular sectional shape. The heat exchange portion is thus divided into a plurality of blocks. As shown in FIG. 6, each of the heat exchange units 306 is formed with a frame consisting of rectangular side plates, a rectangular upper plate, a rectangular bottom plate and a rectangular partition plate with its front and rear sides left open; and by arranging a plurality of heat pipes at equal spacing to pierce through the partition plate and to form a square pillar-like group of pipes.

The heat exchange units $\mathbf{306}_1$, $\mathbf{306}_2$, . . . $\mathbf{306}_{12}$ are arranged one after another in the peripheral area of a partition plate 314 through the spacers 305 with the side plates 307 which are arrayed in a radial manner thus serving as partition walls 315 separating each square pillar like pipe group from the other as blocks that constitute the polygonal tubular form of the heat exchange portion 301. On both the upper and lower faces of the partition plate 314 which is disposed in a hollow part 301*a*, rectifiers 316 are provided in an approximately circular conic form concentrically with the partition plate 314.

The circumferential wall of the casing 302 which houses the heat exchange portion 301 is shaped into a helical form thus forming a hollow cylindrical body 302*a* with its end of the helical form left open. In about the middle part inside the circumferential wall of the hollow cylindrical body 302*a*, there is horizontally disposed an annular partition plate 302*b* to form ducts 317 above and below the partition plate. The open end of the helical form of the casing 302 is divided into upper and lower parts by the partition plate 302*b*. The upper part of the open end serves as an exhaust port 302*c* from which a low temperature gas such as air is allowed to be discharged after it has been heated; while the lower part serves as an intake port 302*d* for introducing a high temperature gas such as a waste gas therethrough. Further, in the upper side of the casing 302, there is provided an intake port 302*e* which communicates with a hollow part 301*a* of the heat exchange portion 301 and is disposed concentrically with the hollow part for introducing therein a low temperature gas. In the lower side of the casing 302, there is provided an exhaust port 302*f* concentrically with a hollow part 301*b* of the heat exchange portion 301 for allowing the high temperature gas which is taken in from the intake port 302*d* to be discharged from there passing through the hollow part 301*b* after heat exchange has been accomplished.

With the cylindrical heat-pipe type heat exchanger assembled by placing the heat exchange portion 301 inside the casing 302 which is constructed as described in the foregoing, the gas flow rectifiers 316 on both sides of the partition plate 314 are disposed concentrically with the intake port 302*e* and the exhaust port 302*f*. Under this condition, a low temperature gas is taken into the radiating portion 303 from the intake port 302*e* which is provided in the upper side of the casing 302 while a high temperature gas is taken into the heat receiving portion 304 from the exhaust port 302*d* which is provided in the lower side of the casing 302. Then, the high temperature gas which is blown in moves forward while revolving along the circumferential wall face inside the lower duct 317. Then, it comes into each block divided by the partition walls 315 to pass through the square pillar like configuration of the heat pipe group 313 for heat exchange and, after it is cooled there, reaches the hollow part 301*b* of the heat exchange portion 301 before it is discharged from the exhaust port 302*f* disposed in the lower side of the casing 302. In this instance, the gas which is blown into the hollow part 301*b* after passing through the heat exchange portion 301 is smoothly discharged to the outside by virtue of the approximately circular conical rectifier 316, so that occurrence of a turbulent flow inside the hollow part 301*b* can be effectively prevented.

The heat pipes 312 are prepared by putting an working liquid in metal tubes which are sealed under reduced pressure. The heat absorbed by heat exchange with a high temperature gas is quickly transmitted to the side of the radiating portion 303 for heat exchange with a low temperature gas taken in from the intake port 302*e* to heat the low temperature gas there. Since the rectifier 316 is disposed below the intake port 302*e* concentrically with the port 302*e* in the same manner as in the case of the heat receiving portion 304, the gas which has flowed into the hollow part 301*a* of the heat exchange portion 301 from the intake port 302*e* provided in the upper side of the casing 302 is uniformly distributed throughout the whole circumference of the heat exchange portion 301 without causing any turbulent flow or channelling inside the hollow part 301*a*. Therefore, the gas flows there almost at a uniform rate, so that heat exchange can be performed efficiently.

With the heat exchange units prepared beforehand as shown in FIG. 6, they can be very easily assembled into a polygonal assembly to facilitate the manufacture of a heat exchanger of a prefabricated type. This embodiment is particularly advantageous in the case of a heat exchanging system of a large capacity as the size of the system can be made smaller in accordance with the embodiment example.

Further, referring to FIGS. 15(A) and (B), the heat exchange efficiency can be further increased by arranging the rectifiers 316 away from the rear side of helical form of the casing 302 instead of positioning them in the middle part of the partition plate 314. In other words, a better efficiency can be obtained with the rectifiers disposed at a higher position as viewed in the drawing. Generally, on the side of the heat receiving portion 304, gas supply to a deeper place in the helical form of the casing tends to become insufficient due to wall face resistance inside the duct 317. However, such eccentric positioning of the rectifier 316 serves to uniformalize the gas flow as a whole. The supply of gas to a deeper place in the helical form decreases also on the side of the radiating portion 303. However, with the rectifier 316 also eccentrically positioned in the same manner, the supply of gas can be uniformly distributed including the deeper side of the heat exchange portion 301 where gas flow tends to become insufficient.

FIGS. 16(A) and (B) illustrate an example of modification wherein the rectifiers 316 are disposed at the center of the partition plate 314 and concentrically with the intake and exhaust ports 302*e* and 302*f* respectively. However, the rectifiers 316 are formed in an approximately circular conic shape with their vertexes eccentrically located away from the deeper part of the helical form of the casing.

FIGS. 17(A) and (B) illustrate another example of modification wherein the rectifiers 316 are formed in a helical approximate circular conic shape having a concavely curved face 316*a* formed at the end of its spread-out bottom side respectively; and these rectifiers are attached to the partition plate 314 with these concavely curved faces directed to the deeper part of the helical form of the casing 302 respectively.

Figure 13:
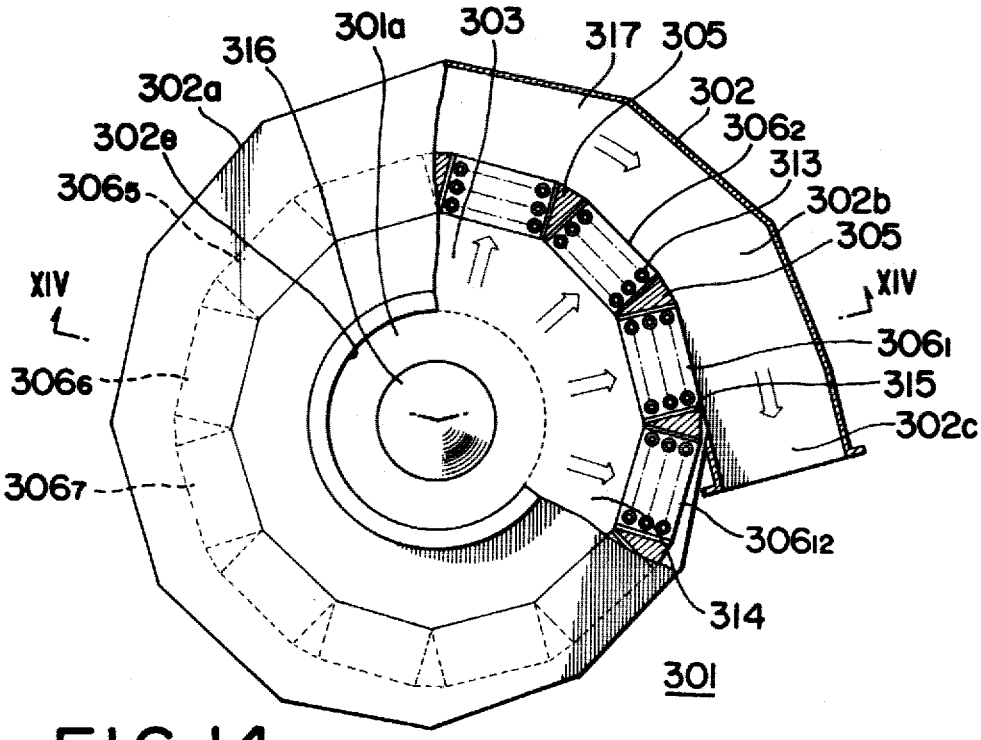
FIG. 13 is a partially cutaway plan view showing a cylindrical heat-pipe type heat exchanger as still another embodiment of the invention (Example 4).
Figure 14:
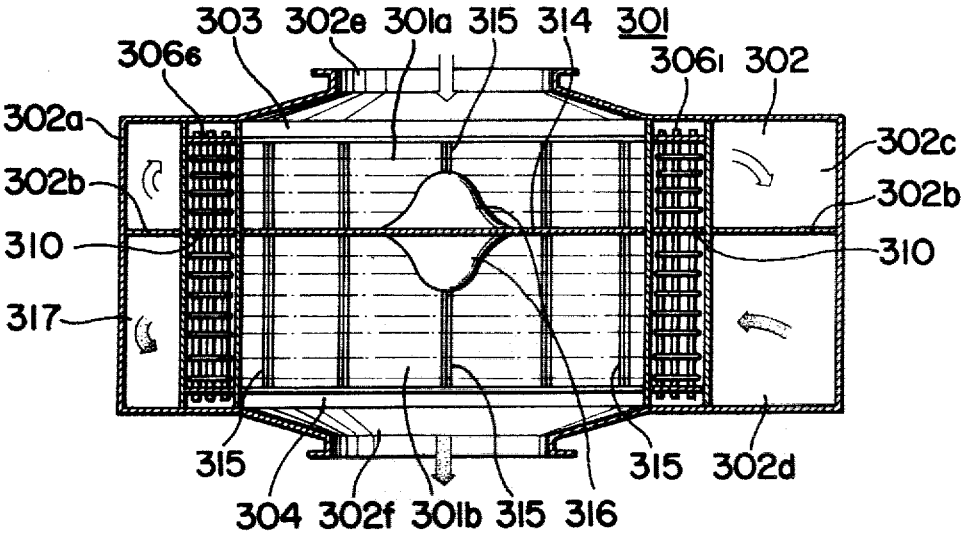
FIG. 14 is a sectional view taken across a line XIV—XIV shown in FIG. 13.

FIGS. 18(A) and (B) illustrate rectifiers 316 which are formed in the same approximate circular conic shape as the ones shown in FIG. 13. They are disposed concentrically with the partition plate 314 while, in this case, the intake and exhaust ports 302*e* and 302*f* provided in the upper and lower sides of the casing 301 are disposed deeper in the helical form of the casing 302 and eccentrically with these rectifiers 316.

The modifications shown in FIGS. 16 through 18 operate in the same manner as the embodiment shown in FIG. 15 and uneven flow or channelling of gas inside the hollow parts 301*a* and 301*b* is prevented to ensure uniform supply and discharge of gas for improvement in heat exchange efficiency.

In the embodiment described in the foregoing, all of the rectifiers 316 have smooth surfaces. However, the present invention is not limited to such rectifiers and rectifiers having pleats or creases in their longitudinal direction may be employed. Further, the heat exchange portion 301 is not limited to the unit prefabricating type described in the foregoing but the heat exchange portion 301 may be prepared in the form of a single unit from the beginning and is divided by partition walls 315 into a plurality of blocks. Also, the partition walls 316 may be dispensed with and a cylindrical heat exchange portion 301 may be formed by annularly arranging a plurality of heat pipes 312 to pierce through a circular partition plate 314. The following is the detailed description of experiments conducted relative to the present embodiment of the invention:

Heat pipes 312 were prepared using copper for an inner tube and carbon steel for an outer tube. Thus each heat pipe was a duplex tube measuring 25.4 mm in outer diameter and 3800 mm in length. Fins made of carbon steel each measuring 52.4 mm in outer diameter were attached to the outside of the double tube at a fin pitch of 3.5 mm. A diphenyl oil heat transfer medium is placed in the duplex tube as working liquid and the tube was sealed. A total of 288 heat pipes prepared in this manner were arranged to pierce through a partition plate as shown in FIG. 6 in 24 rows×12 tiers to assemble them into a heat exchange unit. A total of 12 heat exchange units assembled in this manner ($306_1$, $306_2$, . . . $306_{12}$) were arranged on the circumference of a dodecagonal partition plate 314 which was provided with rectifiers 316 of an approximate circular conic shape on both the upper and lower sides thereof as shown in FIG. 13 to form a heat exchange portion 301. The heat exchange portion 301 was installed inside a helical casing 302 which had intake and exhaust ports 302*e* and 302*f* disposed in the upper and lower sides thereof concentrically with the partition plate 314. A cylindrical heat-pipe type heat exchanger is assembled in this manner as shown in FIG. 13. In this case, each rectifier 316 was formed into an approximate circular conic shape measuring 2000 mm in bottom diameter and 1000 mm in height and was disposed at the center of the partition plate 314 as shown in FIG. 13.

With a heat exchanger assembled as described above, heat exchange between a high temperature gas and a low temperature gas was conducted under the conditions as shown in Table 2. The quantity of heat exchange obtained through this experiment was $9.0\times10^6$ Kcal/h.

TABLE 2

| | Endothermic portion side (high tempe.) | Radiating portion side (low temp.) |
|---|---|---|
| Entrance temperature: | 250° C. | 20° C. |
| Exit temperature: | 153° C. | 170° C. |
| Quantity of flow: | 325,000 $Nm^3/h$ | 210,000 $Nm^3/h$ |
| Total pressure loss: | 36 mm Aq | 28 mm Aq |

Further, the heat exchanger was modified by changing the position of the rectifiers 316 from the center of the partition plate 314 as shown in FIG. 15 to a position 500 mm away from the center (upward therefrom as viewed in the drawing). With this modification, the quantity of heat exchange was also measured. The result is $9.6\times10^6$ Kcal/h which indicates further improvement in heat exchange efficiency.

On the other hand, for comparison with the invented heat exchanger, an experiment was also conducted with a heat exchanger which was not provided with the rectifiers 316. The result of this is $8.0\times10^6$ Kcal/h. Compared with this, the invented heat exchanger improves the heat exchange efficiency by 12 to 20%.

As described in the foregoing, in accordance with the present embodiment example of the invention, uneven gas flow or channelling of it is prevented to ensure uniform gas flow throughout the whole circumference of the heat exchange portion. This equalizes the load on each heat pipe so that the heat exchange efficiency can be enhanced to a great extent; a calorie computation can be facilitated; and the size of a system of a large heat exchange capacity can be made smaller. These are conspicuous advantages of the invented heat exchanger.

EXAMPLE 5 (FIGS. 19–25)

Referring to FIGS. 19 through 25, a reference numeral 401 indicates a heat exchange portion which is formed into a polygonal tubular shape; 402 a casing which houses the heat exchange portion 401 therein; 403 a radiating portion where a low temperature gas to be heated is allowed to flow; and 404 an endothermic portion which is arranged below the radiating portion to allow a high temperature gas to flow there.

The heat exchange portion 401 is composed of 12 heat exchange units $406_1$, $406_2$, . . . $406_{12}$ which are annularly arranged at an angle of 30 degrees through spacers 405 of a triangular sectional shape, the heat exchange portion thus being formed in a polygonal tubular shape divided into a plurality of blocks. Each of the heat exchange units 406 is composed of a square pillar like configuration of a plurality of heat pipes and a frame which is formed by rectangular side plates, a rectangular upper plate, a rectangular bottom plate and a rectangular partition plate with the finned heat pipes arranged at even spacing to pierce through the partition plate. In this case, the number of files of heat pipes contained in each heat exchange unit is arranged to gradually decrease, for example, by one in such a manner that the number of files of heat pipes in the first unit is 14 while the number of files in the 12th unit is 3; or the number of files of heat pipes may be arranged to decrease in a different manner, for example, to decrease at every several units.

These heat exchange units $406_1$, $406_2$, . . . $406_{12}$ are arranged one after another on the circumference of a polygonal partition plate 416 through the spacers 405. Then, the side plates mentioned above are radially arrayed to serve as partition walls 415, each block divided by these partition walls forming a square pillar like pipe group to constitute the polygonal tubular heat exchange portion 401.

The casing 402 which houses the heat exchange portion 401 has its circumferential wall face shaped in a helical form. The helical form of the casing forms a hollow cylindrical body 402*a* with the end of the helical form left open. In the middle part of the hollow cylindrical body 402*a*, there is horizontally provided an annular partition plate 402*b* with ducts 416 formed above and below the annular partition plate 402*b*. At the open end of the helical form of the casing 402 which is also divided by the annular partition plate 402*b*, the upper part of the open end is used as exhaust port 402*c* for allowing a low temperature gas such as air to be discharged therethrough after it has been heated; while the lower part of the open end is used as intake port 402*d* for introducing a high temperature gas such as a waste gas. Further, in the upper side of the casing 402, there is provided an intake port 402*e* which communicates with a hollow part 401*a* of the heat exchange portion 401 for introducing therein a low temperature gas; while, in the lower side of the casing, there is provided an exhaust port 402*f* which allows the high temperature gas to be discharged therefrom passing through another hollow part 401*b* after heat exchange has been accomplished.

The cylindrical heat-pipe type heat exchanger of the above described construction operates as follows: A low temperature gas is taken into a radiating portion 403 from the intake port 402*e* provided in the upper side of the casing 402 while a high temperature gas is taken into an endothermic portion 404 from the intake port 402*d* provided in the lower part of the open end of the casing 402. Then, the high temperature gas which is blown into the casing moves forward while revolving along the circumferential wall face inside the duct 416 and comes to pass each part divided by the partition walls 415 and each square pillar-like configuration of the heat pipe group 413 for heat exchange there. The gas reaches the middle part of the heat exchange portion 401 after it is cooled through heat exchange and then is discharged to the outside from the exhaust port 402*f* provided in the lower side of the casing 402.

Each duct 416 to becomes narrower in the deeper parts of the helical form of the casing and pressure loss increases in the part of the heat exchange portion 401 which is located deeper in the helical form of the casing because of the resistance of the wall face of the duct 416. However, since the heat exchange units $406_1$, $406_2$, . . . $406_{12}$ are arranged to gradually reduce the pressure loss of the gas passing there with the number of files of heat pipes gradually reduced, the rate of gas flow is approximately uniformalized throughout the heat exchange portion 401. Further, the radial array of the partition walls 415 serves to ensure uniform flow of the high temperature gas into blocks separated by the partition walls, so that heat exchange can be efficiently accomplished.

Heat pipes are prepared by enclosing an operating liquid in metal tubes which are sealed under reduced pressure. The heat absorbed through heat exchange is quickly transmitted to the side of the radiating portion 403 to heat a low temperature gas coming from the intake port 402*e* through heat exchange with the low temperature gas there. In this case, the low temperature gas which is allowed to flow into the middle part of the heat exchange portion 401 from the intake port 402*e* provided in the upper side of the casing 402 is caused by the radial array of the partition walls 415 to uniformly flow into the blocks separated by these partition walls. The low temperature gas is thus thoroughly heated through these pipe groups 413 and then moves revolving along the circumferential wall face of the helical form of the casing before it is discharged from the exhaust port 402*c* to the outside. Since the number of files of heat pipes in these heat exchange units gradually decreases according as the units are located deeper in the helical form of the casing so as to lessen the pressure loss there in the same manner as in the case of the endothermic portion 404, the low temperature gas flows through the heat exchange portion 401 at an approximately uniform rate throughout the whole circumferential area of the heat exchange portion despite the adverse effect of the wall face resistance of the duct 416 and that of turbulent flow resistance.

With the heat exchange units prepared beforehand as shown in FIG. 6, the prefabrication type heat exchanger 401 can be very easily prepared by assembling these units. Besides, such arrangement permits reduction in size particularly in the case of a system of large heat exchange capacity.

The form of the heat exchange portion 401 is not limited to the dodecagonal form and any form may be selected as desired. In the foregoing description, the heat exchange units 406 are arranged through the spacers 405. However they may be connected to each other by some connecting means without using such spacers.

Figure 21:
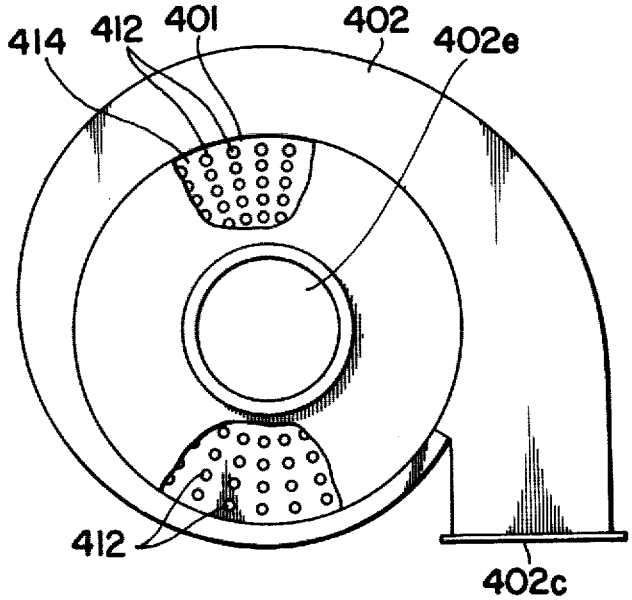
FIG. 21 is a partially cutaway plan view showing a cylindrical heat-pipe type heat exchanger provided with a heat exchange portion having heat pipes arranged at different pitches or spacings.

FIG. 21 shows an example of modification wherein a cylindrical heat-pipe type heat exchanger is prepared by installing a cylindrical heat exchange portion 401 which is not provided with the partition walls 415 inside a helical casing 402.

The above stated heat exchange portion 401 is formed by annularly arranging a plurality of heat pipes 412 to pierce through a circular partition plate 414 with the pitch or spacing between one heat pipe and another being arranged to gradually increase according as they are located further away from the open end of the helical form of the casing and deeper inside the helical form. This heat exchange portion 401 is also arranged to ensure a uniform rate of gas flow throughout the whole circumferential area of the heat exchange portion by gradually reducing the influence of pressure loss due to the resistance of the wall face of the duct 416 and the resistance of a turbulent flow.

Figure 22:
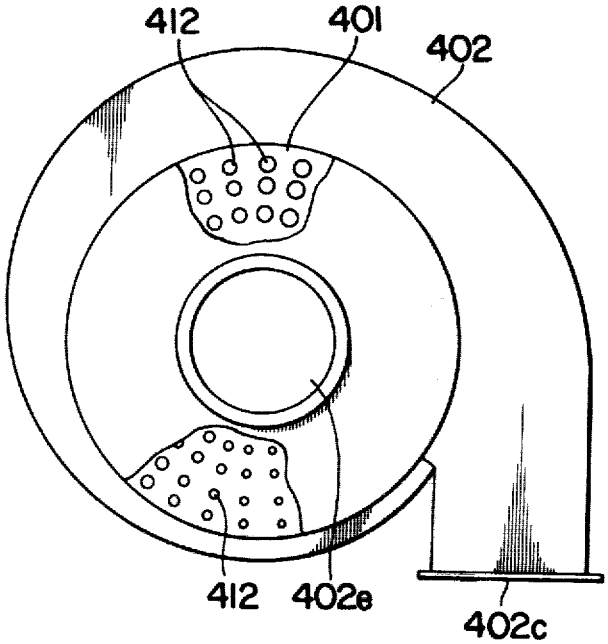

FIG. 22 shows another modification example, wherein a heat exchange portion 401 is formed by annularly arranging a plurality of heat pipes 412 to pierce through a circular partition plate 414 with the diameter of these heat pipes arranged to gradually decrease according as they are located further away from the open end of the helical form of the casing 402 and deeper inside the helical form.

Figure 23:
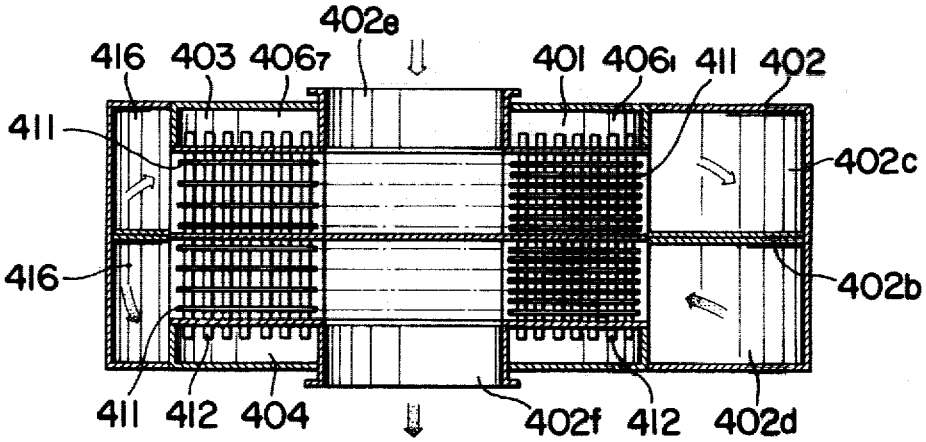
FIG. 23 is a vertical sectional view showing a cylindrical heat-pipe type heat exchanger provided with a heat exchange portion wherein fins are arranged at different pitches.

FIG. 23 shows still another modification example, wherein a heat exchange portion 401 is composed of heat pipes 412 to which plate fins 411 are attached in such a manner that: the pitch or spacing between the fins on the heat pipes is arranged to increase according as they are located further away from the open end of the helical casing 402 and deeper in the helical form so that the pressure loss can be reduced in the deeper area therein.

Figure 24:
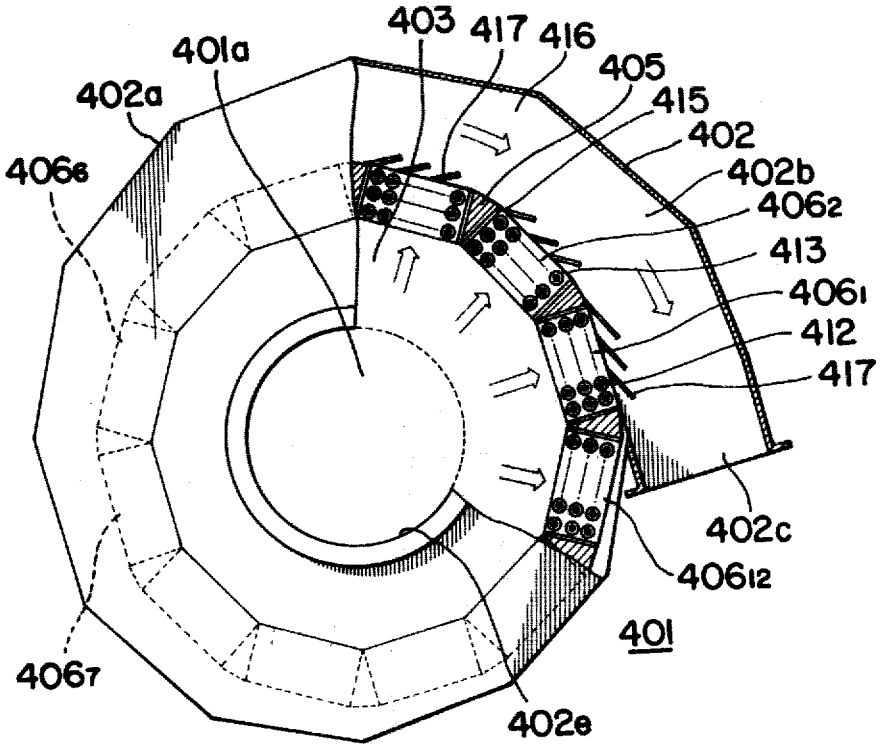
FIG. 24 is a partially cutaway plan view showing a cylindrical heat-pipe heat exchanger provided with a heat exchange portion to which air flow shield plates are attached.
Figure 25:
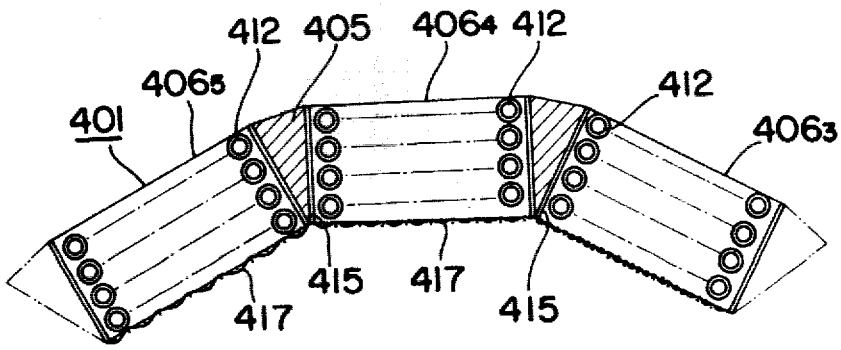
FIG. 25 is a plan view showing essential parts of a heat exchange portion wherein wire gauze is used for air or gas flow shield plates.

FIG. 24 shows a further modification example, wherein air or gas flow shield plates 417 are provided on the heat exchange units $\mathbf{406}_1$, $\mathbf{406}_2$, . . . which are separated from each other by the partition walls 415. The width of the air flow shield plates are arranged to decrease according as they are located further away from the open end of the helical form of the casing and deeper inside the helical form in such a manner as to reduce pressure loss in the deeper area therein.

The air flow shield plates 417 do not have to be stationarily fixed but may be rotatably attached to the heat exchange units with those plates that are attached to the same heat exchange unit being connected to each other by a connecting rod to permit local adjustment of gas flow. Further, the air flow shield plates 417 may be replaced with wire gauze with the size of mesh thereof being arranged to gradually increase according to the location of the gauze.

This invention is not limited to the above described embodiment and its modification examples. The number of files of heat pipes, their pitches, the pitch between fins and the size of the air flow shield plates 417 may be changed by combining two or more of such methods as desired. Also, the heat exchange portion 401 does not have to be divided by the partition walls 415. The following describes experiments conducted with respect to the present embodiment example:

Each heat pipe 412 was manufactured by attaching fins 411 made of carbon steel measuring 52.4 mm in outer diameter at a fin pitch of 3.5 mm to the outside of a double tube made of copper for its inner tube and carbon steel for its outer tube measuring 25.4 mm in outer diameter and 3,800 mm in length and by putting a diphenyl oil heat transfer medium inside the heat pipe as operating liquid.

Figure 19:
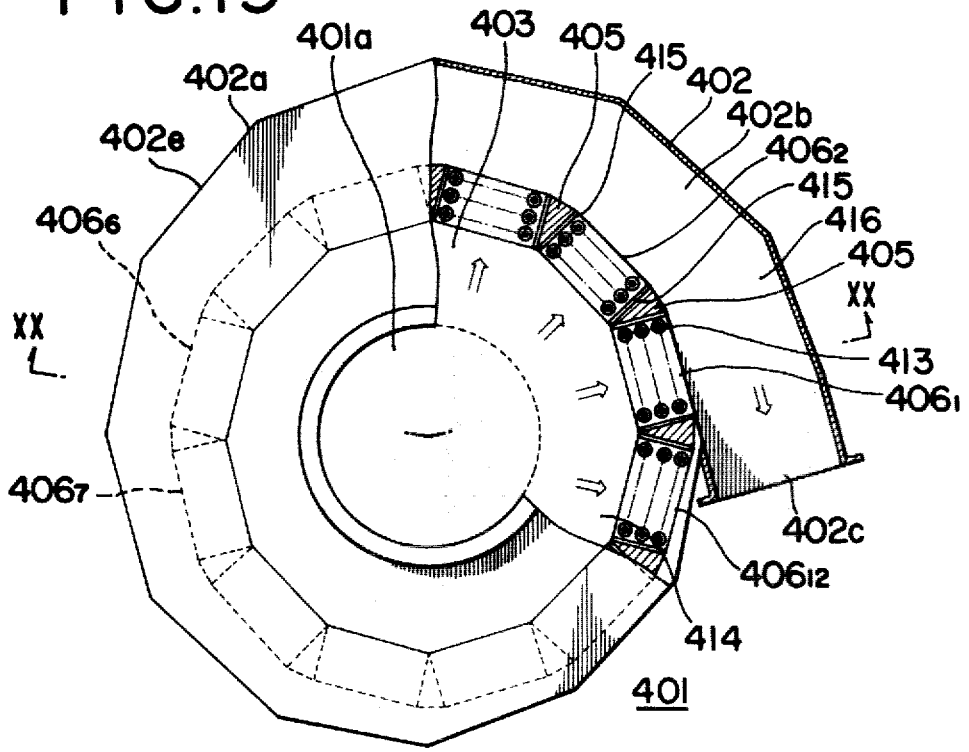
FIG. 19 is a partially cutaway plan view showing a cylindrical heat-pipe type heat exchanger as a still further embodiment of the invention (Example 5).
Figure 20:
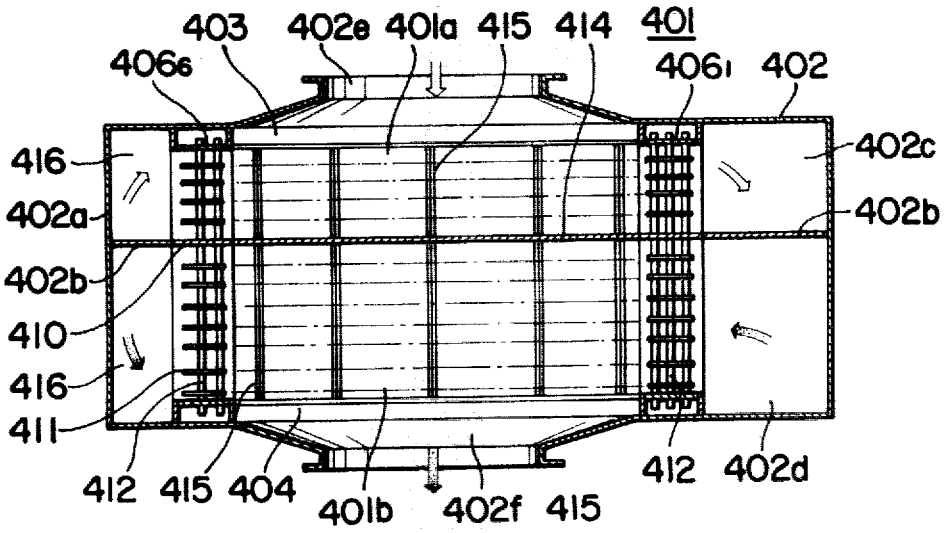
FIG. 20 is a sectional view taken across a line XX—XX shown in FIG. 19.

A dodecagonal cylindrical heat exchange portion 401 was prepared by assembling the heat pipes 412 into each of the heat exchange units $\mathbf{406}_1$, $\mathbf{406}_2$, . . . $\mathbf{406}_{12}$ with the number of files of the heat pipes being arranged to vary according to the position of each unit as shown in FIG. 19 and 20. The number of heat pipes and their arrangement in each unit were as shown in Table 3 below. A total of 3,456 heat pipes were used.

TABLE 3

| Unit No. | Number of heat pipes arranged |
|---|---|
| No. 1 and No. 2 | 2 × 24 rows × 14 files = 672 |
| No. 3 and No. 4 | 2 × 24 rows × 13 files = 624 |
| No. 5 and No. 6 | 2 × 24 rows × 12 files = 576 |
| No. 7 and No. 8 | 2 × 24 rows × 12 files = 576 |
| No. 9 and No. 10 | 2 × 24 rows × 11 files = 528 |
| No. 11 and No. 12 | 2 × 24 rows × 10 files = 480 |

The heat exchange portion 401 which was assembled as described in the foregoing was installed inside a casing 402 and heat exchange was carried out under the conditions as shown in Table 4 below. The quantity of heat exchange was $9.6\times10^6$ Kcal/h.

TABLE 4

| | High temperature side (endothermic portion) | Low temperature side (radiating portion) |
|---|---|---|
| Entrance temperature: | 250° C. | 20° C. |
| Exit temperature: | 153° C. | 170° C. |
| Quantity of flow: | 325,000 $Nm^3/h$ | 210,000 $Nm^3/h$ |
| Total pressure loss: | 36 mm Ag | 28 mm Ag |

For comparison with the invented heat exchanger, a cylindrical heat-pipe type heat exchanger was prepared by assembling heat exchange units $\mathbf{406}_1$, $\mathbf{406}_2$, . . . $\mathbf{406}_{12}$ with heat pipes 412 arranged in 24 rows×12 files in every unit. The measured value of heat exchange quantity was $8.0\times10^6$ Kcal/h. This indicates that the heat exchange efficiency was increased by 20% in accordance with the present embodiment example of this invention.

As described in the foregoing, with the cylindrical heat-pipe type exchanger of the present embodiment of this invention, the flow rate of gas is made approximately uniform throughout the whole circumferential area of the cylindrical heat exchange portion to equalize the load on each of the heat pipes for great improvement in the heat exchange efficiency. It is particularly advantageous that this embodiment permits reduction in the size of a large capacity heat exchanger. Besides, another advantage lies in that the use of the invented heat exchanger facilitates calorie computation.

Figure 26:
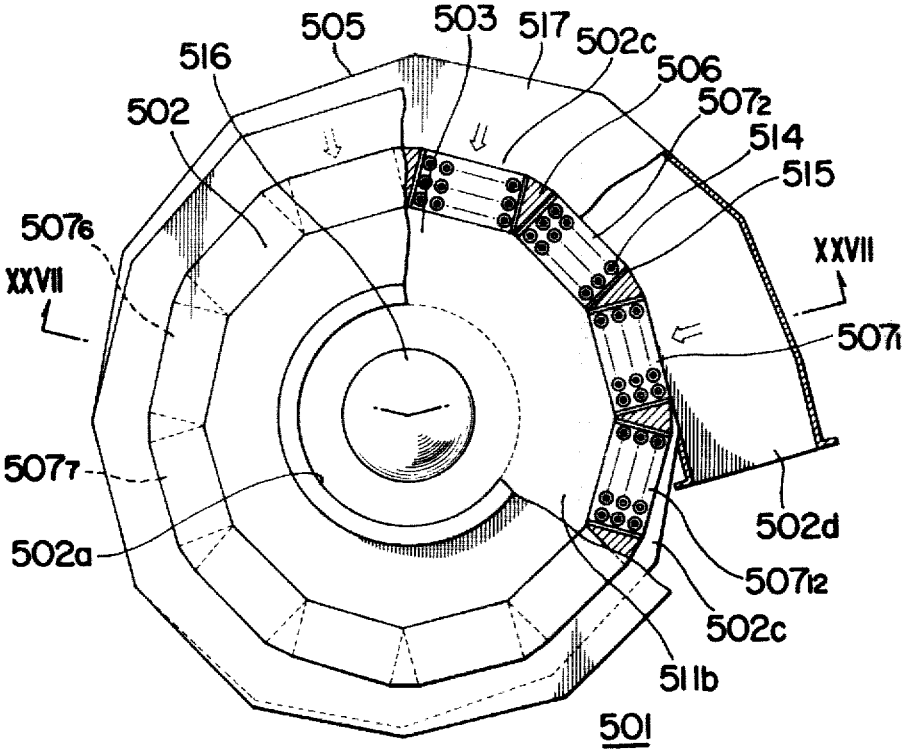
FIG. 26 is a partially cutaway plan view showing a cylindrical heat-pipe type air preheater as an embodiment of the present invention (Example 6).
Figure 27:
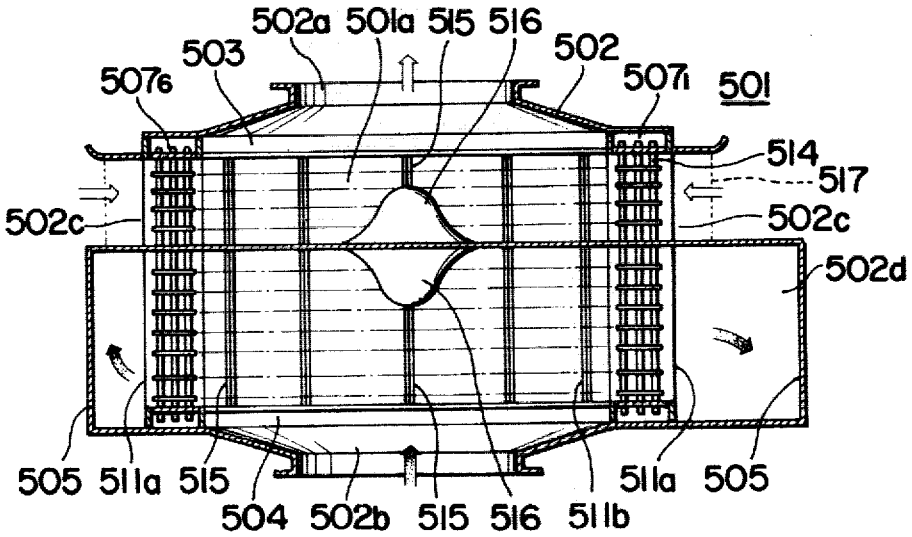
FIG. 27 is a sectional view taken across a line XXVII—XXVII shown in FIG. 26.

EXAMPLE 6 (FIGS. 26 and 27)

In FIGS. 26 and 27, a reference numeral 501 indicates a heat exchange portion which is formed into a polygonal tubular shape; 502 a casing which houses the heat exchange portion 501; 503 a radiating portion where low temperature air to be heated is allowed to flow; 504 an endothermic portion provided below the radiating portion 503 to allow a high temperature gas to flow therethrough; and 505 a discharge duct provided for discharging the high temperature gas to the outside after it has passed through the endothermic portion.

The heat exchange portion 501 is formed into a polygonal tubular shape by 12 heat exchange units $\mathbf{507}_1$, $\mathbf{507}_2$, . . . $\mathbf{507}_{12}$ annularly arranged with spacers 506 of a triangular sectional shape interposed in between one unit and another at an angle of 30 degrees thus dividing the heat exchange portion into a plurality of blocks. As shown in FIG. 27, each of these heat exchange units is composed of a frame formed by side plates, an upper plate, a bottom plate and a partition plate, with front and rear sides left open respectively, and a plurality of heat pipes which are arranged to pierce through the partition plate at equal spacing to form a pipe group of a square pillar-like shape.

The polygonal tubular heat exchange portion 501 is formed by annularly arranging these heat exchange units $507_1$, $507_2$, . . . $507_{12}$ on the circumference of a polygonal partition plate 511*b* as shown in FIG. 26 through the spacers 506 with the side plates 508 radially arrayed to serve as partition walls separating from each other the square pillar-like configurations of pipe groups arranged as constituent blocks of the heat exchange portion. In a hollow middle part 501*a* of the heat exchange portion 501, there are provided rectifiers 516 on both the upper and lower faces of the partition plate 511*b*. The rectifiers 516 are respectively formed into an approximate circular conic shape and are disposed concentrically with the partition plate 511*b*.

In the upper face of the casing 502 which houses the heat exchange portion 501, there is provided an exhaust port 502*a* which communicates with the hollow part 501*a* and is disposed concentrically therewith to discharge air after it has been heated; while, in the lower side of the casing, there is provided an intake port 502*b* for taking in a high temperature gas therethrough. Further, the circumferential side of the casing 502 is left open. In the upper part of the open circumferential area on the side of the radiating portion 503, there is provided a filter 517 and this part of the casing serves as intake port 502*c* for taking in a low temperature air therethrough. Further, in the lower part of the circumferential area on the side of the endothermic portion 504, there is provided a helical discharge duct 505 which is formed in such a manner as to surround the endothermic portion. The circumferential wall of the discharge duct 505 is shaped into a helical form having an open end, which serves as exhaust port 502*d* to allow the high temperature gas to be discharged to the outside from there after completion of heat exchange.

A cylindrical heat-pipe type air preheater which is constructed as described in the foregoing operates as described below: A high temperature gas is taken into the endothermic portion 504 through the intake port 502*b* provided in the lower side of the casing 502. Then, the rectifier 516 uniformly distributes the high temperature gas taken into the endothermic portion 504. The radial array of partition walls 515 then also causes the high temperature gas to uniformly flow into each constituent block of the heat exchange portion. In each block, the high temperature gas is thoroughly subjected to heat exchange through the pipe group 514 and is cooled. After that, the gas helically revolves while moving along the circumferential wall face inside the discharge duct 505 and is discharged to the outside from the exhaust port 502*d* provided at the end of the helical form.

Through this heat exchange, the operating liquid enclosed in the heat pipes 513 obtains latent heat of vaporaization and vaporizes. The vapor then quickly moves to the radiating portion 503 where the vapor discharges latent heat of condensation and condensates there. This vaporization—condensation cycle is rapidly repeated to transmit the endothermic heat to the radiating portion 503.

On the other hand, air of low temperature is taken into the radiating portion 503 of the heat exchange portion 501 from the intake port 502*c* provided in the upper circumferential side of the casing 502. In the radiating portion 503, the air is heated through heat exchange carried out as described in the foregoing. The heated air is then lifted upward by the rectifier 516 provided in the hollow part 501*a* and then is transferred from the exhaust port 502*a* to a blast furnace or the like.

Since the low temperature air is arranged in this manner to flow directly into the radiating portion 503 of the heat exchange portion from the intake port 502*c* provided in the circumferential side of the casing 2 without passing through any duct, there arises no pressure loss that otherwise results from turbulent flow or wall face resistance of a duct. This not only permits reduction in the size of an intake blower but also make air flow uniform for improved heat exchange efficiency. Further, the radial array of the partition walls 515 ensures fairly uniform flow of gas into and out of each constituent block of the heat exchange portion 501 to prevent uneven gas flow which causes decrease in heat exchange efficiency. Since the heat exchange portion 501 is formed by assembling the heat exchange units which have been fabricated beforehand as shown in FIG. 6 into a polygonal tubular form, it can be readily manufactured. This prefabricating arrangement is advantageous particularly for the manufacture of a large-capacity air preheater.

A heat exchange portion 501 of a dodecagonal form has been described in the foregoing. However, this embodiment is not limited to such a form but the heat exchange portion 501 may be in any other forms such as an octagonal form, a circular form, etc. Further, the invention is not limited to the above described prefabrication type and the heat exchange portion may be fabricated into one unit using one plate in place of the partition plates 511*a* and 511*b*. For example, a polygonal or circular plate may be used for the partition plate with a plurality of partition walls 515 radially disposed on each of the upper and lower faces of the partition plate perpendicularly thereto; and a plurality of heat pipes 513 may be arranged to pierce through the plate within each of the blocks thus defined by these partition blocks 515 to form an air preheater having the same finished appearance as the one shown in FIG. 26. Such arrangement is high suitable for a small air preheater which presents no problem with regard to assembling efficiency. As for the shape of the fins 512, either radial fins or plate fins may be used. Also, the heat pipes may be used without attaching any fins thereto. While the rectifiers 516 are employed in the above described embodiment, the use of such rectifiers is not mandatory, because: The heat exchange may be efficiencyly carried out without such rectifiers as the weight of air decreases when it is heated in the radiating portion and then the heated air moves upward. Besides, the air is being pulled by an unillustrated blower. The following describes an experiment conducted with regard to the present embodiment example:

Using copper for an inner tube and cast steel for an outer tube, a double tube measuring 25.4 mm in outer diameter and 3,000 mm in length was prepared with fins made of carbon steel measuring 52.4 mm in outer diameter provided thereon at a fin pitch of 3.5 mm. Then each heat pipe was prepared by putting water inside the double tube and by sealing it.

Each of the heat exchange units was fabricated by arranging 480 heat pipes 513 to pierce through the partition plate 511*a* at equal spacing as shown in FIG. 6. A total of 12 heat exchange units were annularly arranged on the circumference of the partition plate 511*b* to form the heat exchange portion 501 thus using 5760 pieces of the heat pipes 513 in all.

With the heat exchange portion 501 installed inside the casing 502, a discharge duct was arranged on the side of the endothermic portion 504 to form a cylindrical heat-pipe type air preheater as shown in FIGS. 26 and 27.

A high temperature gas of 250° C. was supplied to the air preheater to preheat air of 15° C. to obtain results of the experiment as shown in Table 5 below. The quantity of heat exchange was $9.8\times10^6$ Kcal/h.

TABLE 5

| | Endothermic side (high temp.) | Radiating side (low temp.) |
|---|---|---|
| Entrance temperature: | 250° C. | 15° C. |
| Exit temperature: | 150° C. | 165° C. |
| Quantity of flow: | 400,000 $Nm^3/h$ | 400,000 $Nm^3/h$ |
| Total pressure loss: | 75 mm $H_2O$ | 50 mm $H_2O$ |

COMPARISON EXAMPLE:

The heat exchange portion 501, the casing 502 which houses the heat exchange portion 501 and the helical discharge duct 505 which is provided on the side of the endothermic portion 504 were formed in the same manner as in the above described embodiment example. In addition an intake duct is formed to surround the radiating portion 503 in the same shape as that of the discharge duct 505 to complete another cylindrical heat-pipe type air preheater.

An experiment was conducted by supplying a high temperature gas of 250° C. to the air preheater. Then, air of 15° C. is supplied to the heat exchange portion 501 through the helical intake duct to preheat the air. The results of the experiment were as shown in Table 6. The quantity of heat exchange was $9.2\times10^6$ Kcal/h.

TABLE 6

| | Endothermic side (high temp.) | Radiating side (low temp.) |
|---|---|---|
| Entrance temperature: | 250° C. | 15° C. |
| Exit temperature: | 160° C. | 155° C. |
| Quantity of flow: | 40,000 $Nm^3/h$ | 40,000 $Nm^3/h$ |
| Total pressure loss: | 80 mm $H_2O$ | 65 mm $H_2O$ |

As apparent from the above results of experiment, the cylindrical heat-pipe type air preheater of the present embodiment example is capable of carrying out heat exchange with high efficiency because it is less affected by pressure loss by virtue of the arrangement to allow the low temperature air to flow directly into the radiating portion exposed to the outside without having any duct around it. Further, with no duct provided on the side of the radiating portion in accordance with the present embodiment example, this permits reduction in the weight and cost of the air preheater. In addition to such advantages, since the present embodiment permits prefabrication, the heat exchange units can be prefabricated at a factory and then they can be readily assembled at the site of installation. This is a salient advantage of the present embodiment with regard to workability particularly in the manufacture of a large air preheater.

What is claimed is:

1. A cylindrical heat exchanger comprising:

a tubular casing provided with openings in middle portions of both an upper side and a lower side and in its circumferential side;

a transverse partition plate dividing the inside of the casing into an upper part and a lower part; and a plurality of heat pipe group units vertically arranged to pierce through the peripheral area of the transverse partition plate and arranged into a polygonal annular configuration as viewed in a plan view, each unit being formed by arranging a plurality of heat pipes into a rectangular sectional configuration, the units being separated from each other by a radial array of vertical partition walls, the heat pipes in each unit being equally spaced;

the upper and lower parts of the inside of the casing being formed to serve as gas flow passages in a counter flowing manner above and below the transverse partition plate;

the upper part of the plurality of heat pipe group units being arranged to function as a radiating portion which allows air to be heated to come into contact therewith flowing therethrough while the lower part of the plurality of heat pipe group units below the partition plate is arranged to function as a heat receiving portion which allows a high temperature gas to come in contact therewith flowing therethrough;

the opening provided in the circumferential side of the casing on the side of the radiating portion being arranged to serve as an intake part for taking in air;

the opening provided in the middle portion of the upper side of the casing being arranged to serve as an exhaust part for the air;

the opening provided in the middle portion of the lower side of the casing being arranged to serve as an intake part for a high temperature gas; and a flat helical duct having an open end is formed to surround the opening provided in the circumferential side of the casing on the side of the heat receiving portion, the open end of the helical duct being arranged to serve as an exhaust port for the high temperature gas.

2. A cylindrical heat exchanger as defined in claim 1, wherein each of said heat pipe group units is a prefabrication type being prefabricated into a form of an independent block by arranging heat pipes to pierce through a horizontal rectangular partition plate with vertical partition walls provided on two opposite sides of the horizontal rectangular partition plate; and the heat exchanger can be assembled by connecting the prefabricated heat pipe group units to said transverse partition plate which is disposed in or around the middle part of said casing.

* * * * *